US005775063A

United States Patent [19]

Ikai et al.

[11] Patent Number: 5,775,063

[45] Date of Patent: Jul. 7, 1998

[54] PROCESS AND APPARATUS FOR ASSEMBLY-PACKAGING PELLET-LIKE ARTICLES

[75] Inventors: Kenji Ikai; Yoshio Kito, both of Nagoya, Japan

[73] Assignee: Fuji Machinery Co., Ltd., Aichi, Japan

[21] Appl. No.: 707,645

[22] Filed: Sep. 5, 1996

[30] Foreign Application Priority Data

Oct. 31, 1995 [JP] Japan ..... 7-308324

[51] Int. Cl.[6] ..... B65B 11/32

[52] U.S. Cl. ..... 53/463; 53/133.8; 53/229; 53/234; 53/412

[58] Field of Search ..... 53/463, 466, 465, 53/461, 412, 542, 532, 234, 229, 228, 226, 225, 133.8

[56] References Cited

U.S. PATENT DOCUMENTS

| | | | |
|---|---|---|---|
| 1,805,693 | 5/1931 | Gladeck | 53/229 |
| 3,987,605 | 10/1976 | Johnson | 53/234 |
| 4,539,792 | 9/1985 | Zamboni | 53/234 |
| 4,776,149 | 10/1988 | Terhorst | 53/229 |
| 5,493,847 | 2/1996 | Spatafora | 53/234 X |

*Primary Examiner*—James F. Coan
*Attorney, Agent, or Firm*—Koda and Androlia

[57] ABSTRACT

Disclosed is a process and an apparatus for assembly-packaging pellet-like articles in units of a predetermined, characterized in that a pellet-like articles group is ejected toward a packaging film locating at a stand-by position to be gripped together with the packaging film half-wrapped around the pellet-like article group by an article holding means; overlapping edges of the packaging film gripped by the article holding means are put together and preheat-seated, followed by sealing thereof to form a sealed rib; the sealed rib is folded down along the barrel of the pellet-like article group and heat-sealed; each open end portion of the tubular packaging film is gussetted and partially sealed; the gussetted and partially sealed portions are sealed fully to form sealed tabs, and the unnecessary portions of the tabs are cut off; and the sealed tabs are folded down along end faces of the assembled pellet-like article group and heat-seated.

7 Claims, 26 Drawing Sheets

(a)

(b)

(c)

( a )

( b )

( b )

( a )

PROCESS AND APPARATUS FOR ASSEMBLY-PACKAGING PELLET-LIKE ARTICLES

BACKGROUND OF THE INVENTION

1. Field of the Invention

This invention relates to a process and an apparatus for assembly-packaging a plurality of pellet-like articles with a film to provide a stick-like package. More specifically, this invention relates to a process for assembly-packaging a plurality of pellet-like articles with a film, which articles are aligned and abutting each other, as well as, folding of each sealed portion along the profile of the assembled articles to provide a tight stick-like package in which the packaging film is tightly fitted along the profile of the articles and also to an apparatus for the same.

2. Description of the Related Art

Pellet-like sweets including candies or pellet-like articles such as pharmaceutical tablets are generally assembled by the unit of a predetermined number and assembly-packaged with a film into a form of stick. As a method of obtaining such package, there is a packaging method as disclosed in Japanese Unexamined Patent Publication No. 13609/1985. According to this method, after a film is half-wrapped around a group of assembled articles into a form of U-shape, the overlapping edges of the U-shaped film are heat-sealed together to form a tube, and the thus heat-sealed rib is folded down along the circumference of the article group. Then, open end portions of the tube extending outer than each end face of the article group are sealed, and after the thus sealed tabs are folded down at the central portions to be abutted against the end faces of the article group, respectively, side flaps of each sealed tab are folded to be abutted against that central portion to obtain a package.

In the packaging method described above, since each sealed tab of the tube is adapted to be folded separately at the central portion and at the side flaps, dull crease lines are formed beforehand so as to demarcate the central portion from the side flaps to facilitate folding of the side flaps. However, since the side flaps of each sealed tab are merely folded to be abutted against the central portion having been folded already, the side flaps cannot be maintained in such folded state depending on the size of the articles (e.g., the articles are of small sizes such as candies) or depending on the material of the film, and the side flaps occasionally lift from the end faces of the article group. Meanwhile, since the heat-sealed rib is merely folded down likewise along the circumference of the article group, the rib can also lift from the circumference of the article group, resulting in the failure of obtaining a package in which the packaging film is tightly fitted along the profile of the article group. Furthermore, since dull crease lines must be formed at the sealed tabs, and since the sealed tabs are folded separately at the central portion and at the side flaps, it can be pointed out that the mechanical constitution is complicated and that the number of steps is increased, disadvantageously.

SUMMARY OF THE INVENTION

This invention is proposed in view of the problems inherent in the prior art described above and with a view to solving them successfully, and it is an objective of the invention to provide a process for assembly-packaging pellet-like articles which can give tightly sealed stick-like packages in which the packaging film is tightly fitted along the profile of the article group, and which can achieve easy and neat folding of sealed tabs at each end of the film, as well as, an apparatus for the same.

In order to overcome the problems described above and to attain the intended objective, the process for assembly-packaging pellet-like articles according to this invention is characterized in that a packaging film obtained by cutting a double-side heat-sealable belt-like film drawn from a web roll into a predetermined length is supplied to a stand-by position; a pellet-like article group, consisting of an assembly of pellet-like articles fed to a position where it opposes the packaging film with the end faces of the pellet-like articles being abutted against one another in alignment, is ejected toward the packaging film at the stand-by position; the thus ejected pellet-like article group and the packaging film half-wrapped around it is gripped with gripping means which is rotated intermittently by predetermined angles; overlapping edges of the packaging film half-wrapped around the pellet-like article group are put together and preheat-sealed to allow the packaging film to have a tubular form, at a stopping position of the gripping means; the preheat-sealed overlapping edges of the packaging film are sealed fully to form a sealed rib, at the next stopping position of the gripping means; the sealed rib is folded along the barrel of the pellet-like article group down and heat-sealed onto the portion of the packaging film opposing the sealed rib, at the next stopping position of the gripping means; both open end portions of the tubular packaging film are gussetted and the overlapping two-sheet portions of the gussetted open end portions remaining ungussetted are sealed, at the next stopping position of the gripping means; the gussetted and preheat-sealed end portions are sealed fully to form sealed tabs, at the next stopping position of the gripping means; the sealed tabs are cut to a predetermined length at the next stopping position of the gripping means; and each sealed tab is folded down along the end face of the assembled pellet-like article group and the thus folded sealed tabs are heat-sealed onto the portions of the packaging film opposing the tabs.

Meanwhile, the apparatus for assembly-packaging pellet-like articles according to another aspect of this invention for suitably carrying out the process of the invention described above is characterized in that it is provided with film feeding means for cutting a double-side heat-sealable belt-like film drawn from a web roll into a sheet with a predetermined length, feeding the thus obtained packaging film to a stand-by position, and holding the film sheet in position; article introducing means for introducing pellet-like articles by a predetermined number in alignment; article feeding means having an ejecting member for ejecting a pellet-like article group consisting of an assembly of the pellet-like articles introduced by the article introducing means with the end faces of the pellet-like articles being abutted against one another in alignment toward the packaging film; an intermittent rotor, disposed to oppose the article feeding means across the stand-by position, which is rotated and stopped by predetermined angles; a plurality of article holding means, disposed on the intermittent rotor at predetermined angular intervals, each containing a supporting member which moves interlocking with the ejecting member in the direction that the member is moved and holds the pellet-like article group and the packaging film in cooperation with the ejecting member and a gripper which grips the pellet-like article group ejected by the ejecting member together with the packaging film half-wrapped around the pellet-like article group against the ejecting direction; first sealing means, which is disposed downstream the position where pellet-like article group is transferred from the article feeding means to the article holding means with respect to the rotational direction of the intermittent rotor and contains a pair of sealers, disposed to be movable closer to and farther from each other, for nipping together overlapping edges of the packaging film half-wrapped around the pellet-like article group gripped by the gripper and preheat-sealing the thus nipped overlapping edges, when the intermittent rotor is at pause; second sealing means, which is disposed downstream the first sealing means with respect to the rotational direction of the intermittent rotor and contains a pair of sealers, disposed to be movable closer to and farther from each other, for nipping the overlapping edges of the packaging film preheat-sealed by the first sealing means and sealing the thus nipped edges to form a sealed rib, when the intermittent rotor is at pause; folding guide means, which is disposed downstream the second sealing means with respect to the rotational direction of the intermittent rotor, for folding down the sealed rib of the packaging film formed by the second sealing means along the barrel of the pellet-like article group with the rotation of the intermittent rotor; third sealing means, which is disposed downstream the folding guide means with respect to the rotational direction of the intermittent rotor, for heat-sealing the thus folded sealed rib onto the portion of the packaging film wrapped along the profile of the pellet-like article group, when the intermittent rotor is at pause; gussetting and sealing means disposed downstream the third sealing means with respect to the rotational direction of the intermittent rotor and contains, on each side of the assembled pellet-like article group, a pair of gussetting pawls which can be moved closer to and farther from each other horizontally with the open end portion of the tubular packaging film being located therebetween and a pair of sealers which can be moved closer to and farther from each other vertically toward the open end portions, so that each open end portion may be folded inward by the gussetting pawls to form a gusset and that each open end portion thus gussetted may be sealed partly by the pair of sealers substantially at the center of the closing stroke of the gussetting pawls, when the intermittent rotor is at pause; fourth sealing means disposed downstream the gussetting and sealing means with respect to the rotational direction of the intermittent rotor and contains, on each side of the assembled pellet-like article group a pair of sealers which can be moved closer to and farther from each other with the open end portion of the packaging film gussetted and partially sealed by the gussetting and sealing means being located therebetween and which nips and seals the gussetted and partially sealed end portion to form a sealed tab, when the intermittent rotor is at pause; sealed tab cutting means which is disposed downstream the fourth sealing means with respect to the rotational direction of the intermittent rotor and contains, on each side of the assembled pellet-like article group, a pair of cutting members for cutting the sealed tabs formed by the fourth sealing means into a predetermined length, when the intermittent rotor is at pause; discharge means disposed adjacent to each cutting member of the sealed tab cutting means, for discharging film chips cut off by the cutting member outside the packaging machine; tab folding means for folding down the thus cut sealed tabs along the end faces of the assembled pellet-like article group; and fifth sealing means for heat-sealing each sealed tab folded by the tab folding means onto the portion of the packaging film opposing the tab.

(Actions)

A belt-like film drawn from a web roll is cut into pieces with a predetermined length. The thus cut packaging film is fed to a stand-by position. A pellet-like article group consisting of an assembly of a predetermined number of pellet-like articles is fed toward the packaging film with the articles being abutted at the end faces against one another in alignment to be half-wrapped with the packaging film. The thus wrapped pellet-like article group is gripped together with the packaging film by gripping means. The gripping means is rotated intermittently downstream and stopped, where the overlapping edges of the packaging film wrapped around the article group are put together and are preheat-sealed to allow the film to have a tubular form. The preheat-sealed overlapping edges of the packaging film are then sealed fully at the next stopping position of the gripping means which is rotated intermittently to form a sealed rib. The thus formed sealed rib is then folded down along the barrel of the pellet-like article group and heat-sealed onto the portion of the packaging film wrapped around the barrel of the article group.

Each open end portion of the tubular packaging film is then subjected to gussetting at another stopping position of the gripping means which is rotated intermittently and also to preheat-sealing so as to maintain the gussetted state. The gussetted portions of the packaging film are then sealed fully at another stopping position of the gripping means which is rotated intermittently, to form sealed tabs. Unnecessary portion of each sealed tab is cut off by a predetermined length at another stopping position of the gripping means which is rotated intermittently and is discharged. After the sealed tabs are folded down along the end faces of the assembled pellet-like article group and heat-sealed onto the opposing portions of the packaging film respectively to provide a tightly sealed package in which the packaging film is tightly fitted along the profile of the article group.

BRIEF DESCRIPTION OF THE DRAWINGS

The features of the present invention that are believed to be novel are set forth with particularity in the appended claims.

The invention, together with the objects and advantages thereof, may best be understood by reference to the following description of the presently preferred embodiments taken in conjunction with the accompanying drawings in which.

DETAILED DESCRIPTION OF THE PREFERRED EMBODIMENTS

Next, the process for assembly-packaging pellet-like articles according to this invention will be described below with relation to an apparatus capable of suitably carrying out the process referring to the attached drawings.

(Film Feeding Unit)

Figure 1:
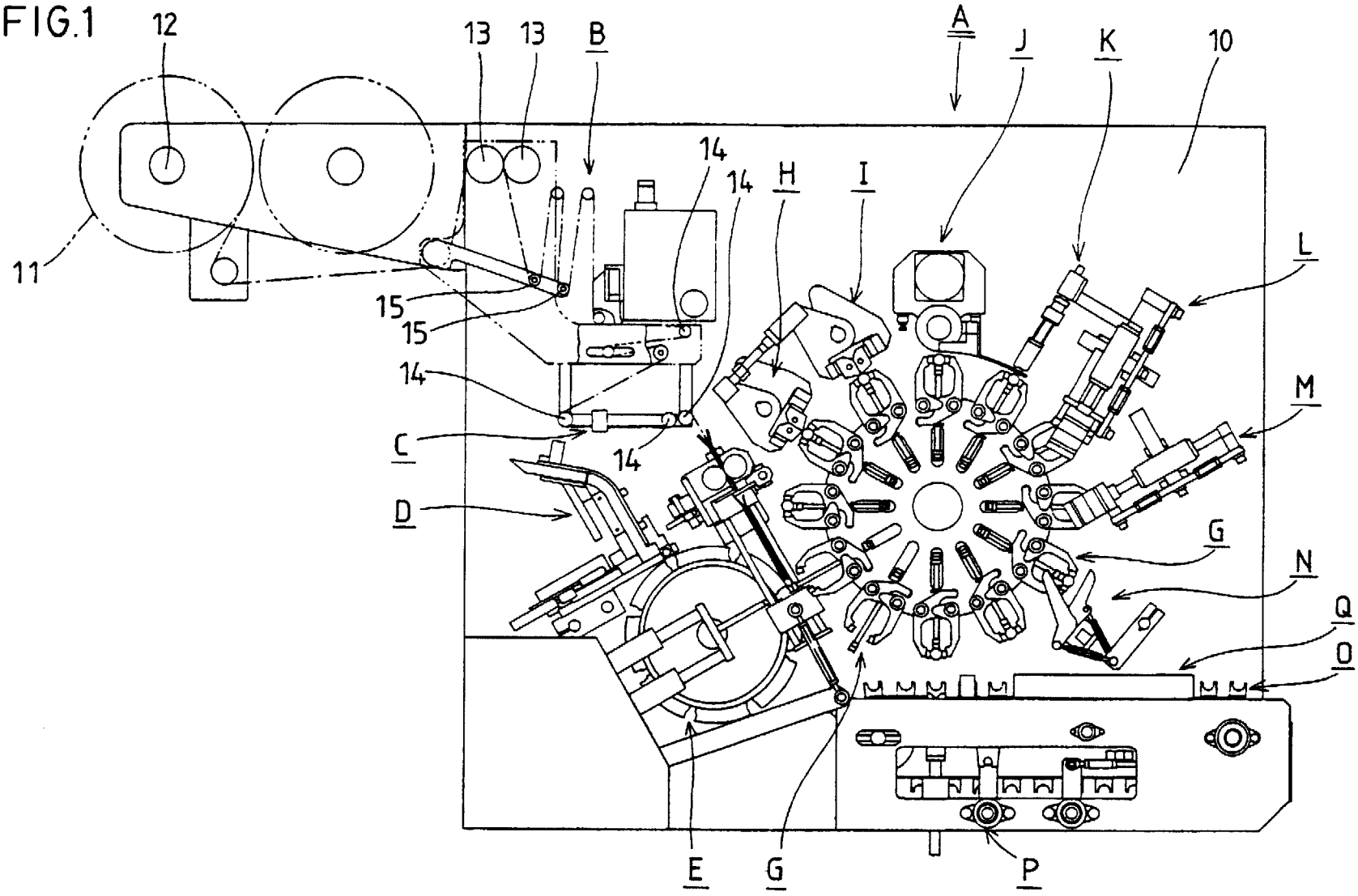
FIG. 1 is a schematic drawing showing the entire constitution of assembly-packaging apparatus according to one embodiment of this invention.

FIG. 1 shows the entire constitution of assembly-packaging apparatus according to one embodiment of this invention. In a frame 10 of the apparatus A, is disposed a film feeding unit (film feeding means) B for drawing a belt-like film F from a web roll 11 and cutting the film F into pieces with a predetermined size to feed the thus cut pieces of packaging film F1 to a stand-by position. More specifically, a roll holder 12 is rotatably cantilevered at a predetermined position of the frame 10, and the web roll 11 which is a roll of double-side heat-sealable belt-like film F is detachably loaded on the roll holder 12. A pair of first feeding rollers 13 are rotatably disposed in the frame 10, and the belt-like film F held between these rollers 13 is drawn by a predetermined length from the web roll 11 by intermittently driving one roller 13 by a motor (not shown). The belt-like film F drawn by the first feeding rollers 13 is adapted to be fed via a plurality of guide rollers 14 disposed in the frame 10 to a film cutting section (to be described later). Incidentally, free rotation of the roll holder 12 when the belt-like film F is drawn out is designed to be braked by braking means (not shown) so that extra belt-like film F may not be drawn. The belt-like film F is wrapped around tension rollers 15 so that a predetermined tension may be applied to the film F.

Figure 2:
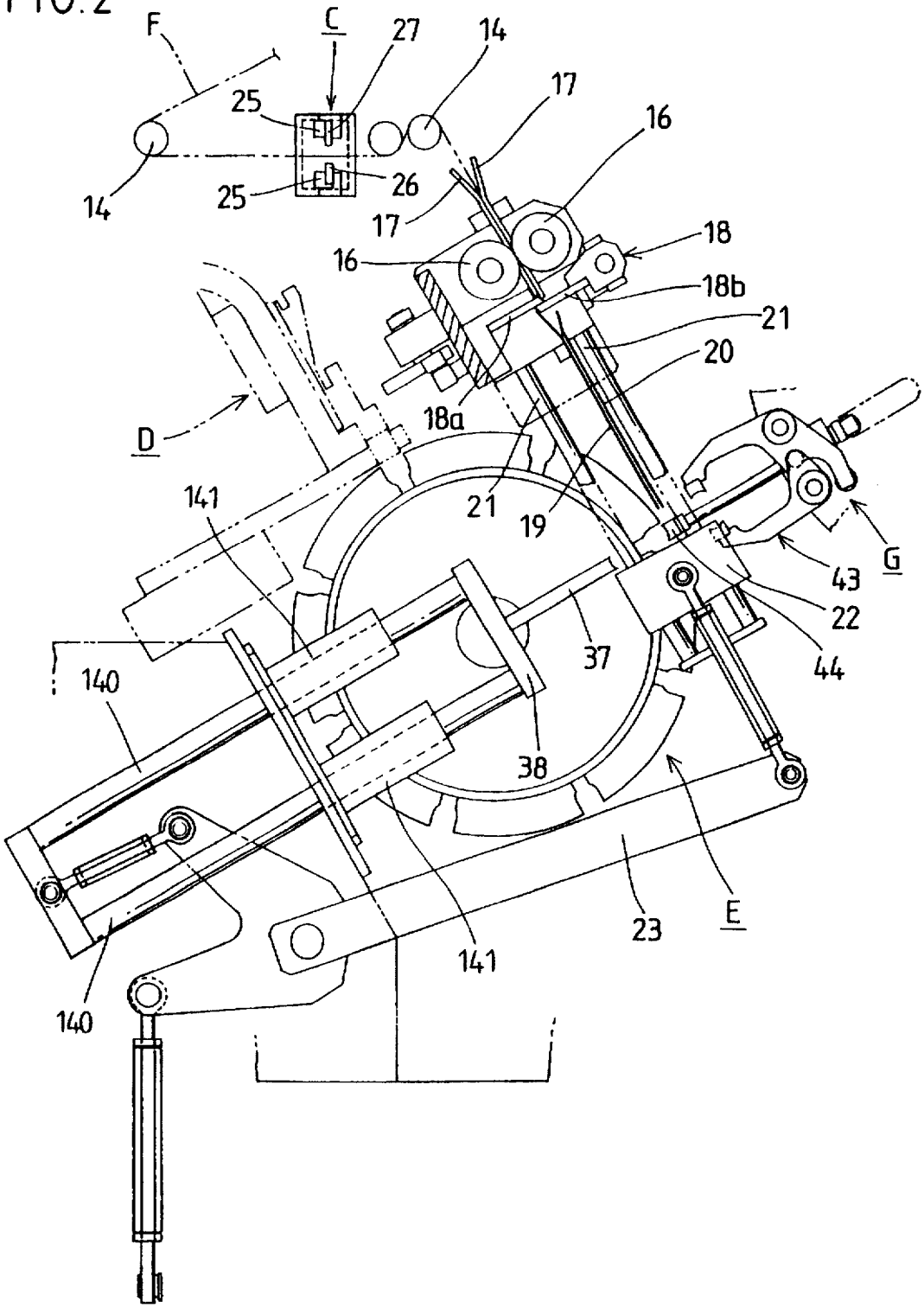
FIG. 2 is front view of the major section of a film feeding unit and an article feeding unit in the assembly-packaging apparatus according to the embodiment.

At the film cutting section, as shown in FIG. 2, a pair of second feeding rollers 16 are rotatably disposed to oppose each other across the route of drawing the belt-like film F. The belt-like film F fed via the guide rollers 14 to and between these rollers 16 is further fed downstream successively by a predetermined length as one second feeding roller 16 is driven intermittently by a motor (not shown). A plurality of grooves 16*a* are formed circumferentially on the second feeding rollers 16 at predetermined intervals in the axial direction (see FIG. 3). A pair of first guide bars 17 are interposed between each pair of grooves 16*a* opposing each other across the film drawing route. The first guide bars 17 are extended from the location of the second feeding rollers 16 upstream and downstream in predetermined lengths respectively with respect to the film drawing direction to guide the belt-like film F to be fed stably. Incidentally, the first feeding rollers 13 and the second feeding rollers 16 are adapted to be synchronously driven intermittently.

A film cutter 18 for cutting the film F crosswise is disposed on the film feed-out side of the first guide bars 17. This film cutter 18 has a fixed blade 18*a* and a movable blade 18*a* opposing each other across the film drawing route, as shown in FIG. 2. The movable blade 18*b* is designed to be operated to be abutted against the fixed blade 18*a* with the timing that the second feeding rollers 16 make a pause to cut the belt-like film F crosswise and prepare a packaging film F1 having a predetermined length.

Figure 3:
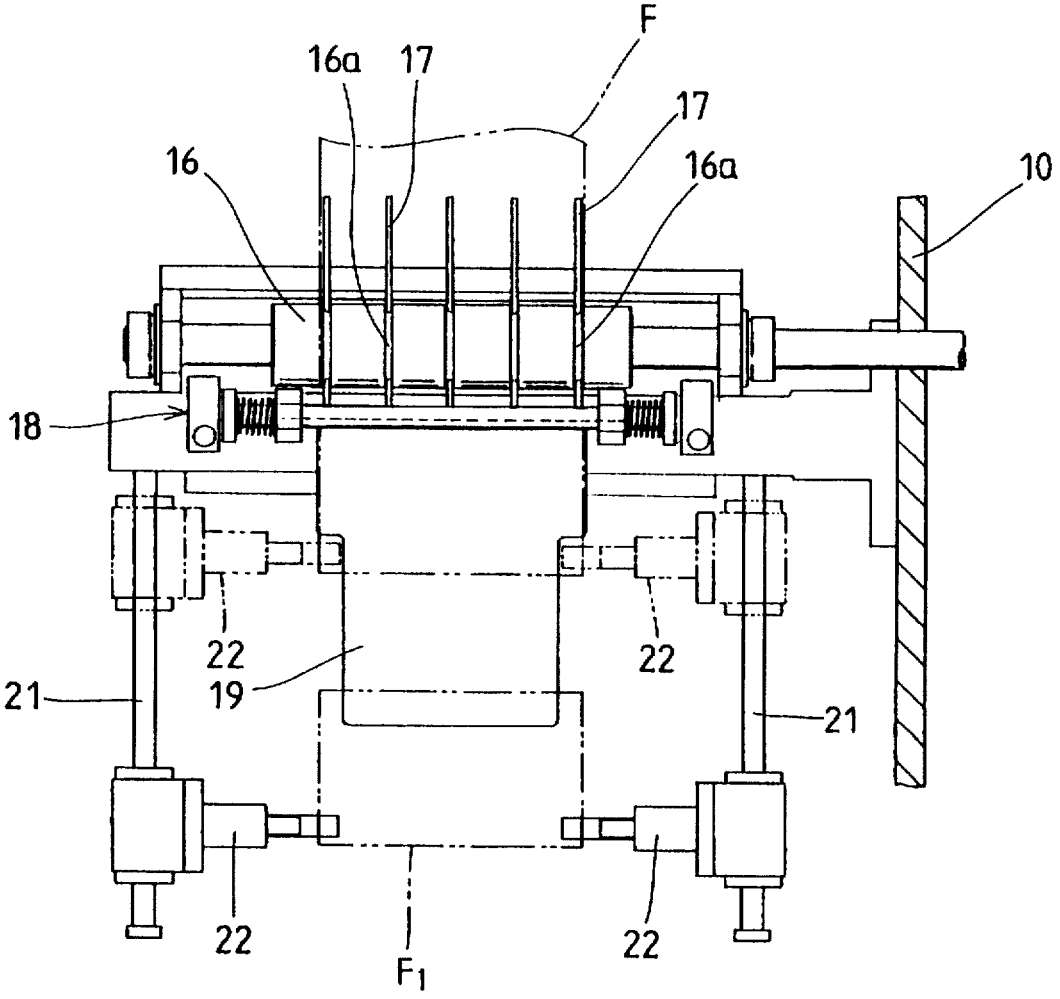
FIG. 3 is a side view of the major section of the film feeding unit according to the embodiment.

A second guide plate 19 is disposed on one side of the film drawing route downstream the location of the film cutter 18 with respect to the film drawing direction; whereas a plurality of second guide bars 20 are disposed vertically on the other side with predetermined intervals in the longitudinal direction of the rollers 16. The packaging film F1 cut by the film cutter 18 is designed to be supported between the second guide plate 19 and the second guide bars 20. Incidentally, the width of the second guide plate 19 is designed to be smaller on the downstream side than the width of the packaging film Fl, as shown in FIG. 3, so that the side edges of the packaging film F1 may be exposed by predetermined lengths outward from the side edges of the second guide plate 19, respectively.

Two pairs of guide rods 21 are arranged on each side of the second guide plate 19 to be parallel therewith, and a chuck 22 is slidably fitted to each pair of guide rods 21. Each chuck 22 is connected via a connecting rod 23 to a main drive source (not shown) so that it may be moved by the main drive source between a chucking position FIG. 4) close to the film cutter 18 and a working position (FIG. 5) spaced downstream away from the second guide plate 19. In the state where the pair of chucks 22 are locating at the chucking position, the side edges of the belt-like film F supported between the second guide plate 19 and the second guide bars 20 are chucked by the chucks 22, and then the chucks 22 are moved to the working position after the belt-like film F is cut by the film cutter 18, so that a predetermined length of packaging film F1 may be fed to the stand-by position where a pellet-like article group 24 is ejected from an article feeding unit E (to be described later).

(Auxiliary slitting Unit)

An auxiliary slitting unit (auxiliary slitting means) C for forming an auxiliary slit r (see FIG. 46) orthogonal to the film drawing direction on the belt-like film F is disposed on the route of drawing the belt-like film F. This auxiliary slitting unit C has a pair of mounts 25 disposed on the upper side and on the lower side of the film drawing route to oppose each other, as shown in FIG. 2.

An anvil 26 is disposed on one mount 25, and a small cutter 27 is disposed on the other mount 25. The small cutter 27 and the anvil 26 are located near one transversal side edge of the belt-like film F and function to form auxiliary slits r over a predetermined length in the film F. Incidentally, the auxiliary slit r locates near one longitudinal edge of the packaging film F1 cut into a predetermined length by the film cutter 18 so as to facilitate opening of the packaging film F1 wrapping the pellet-like article group 24 therein.

(Article Introducing Unit)

Figure 7:
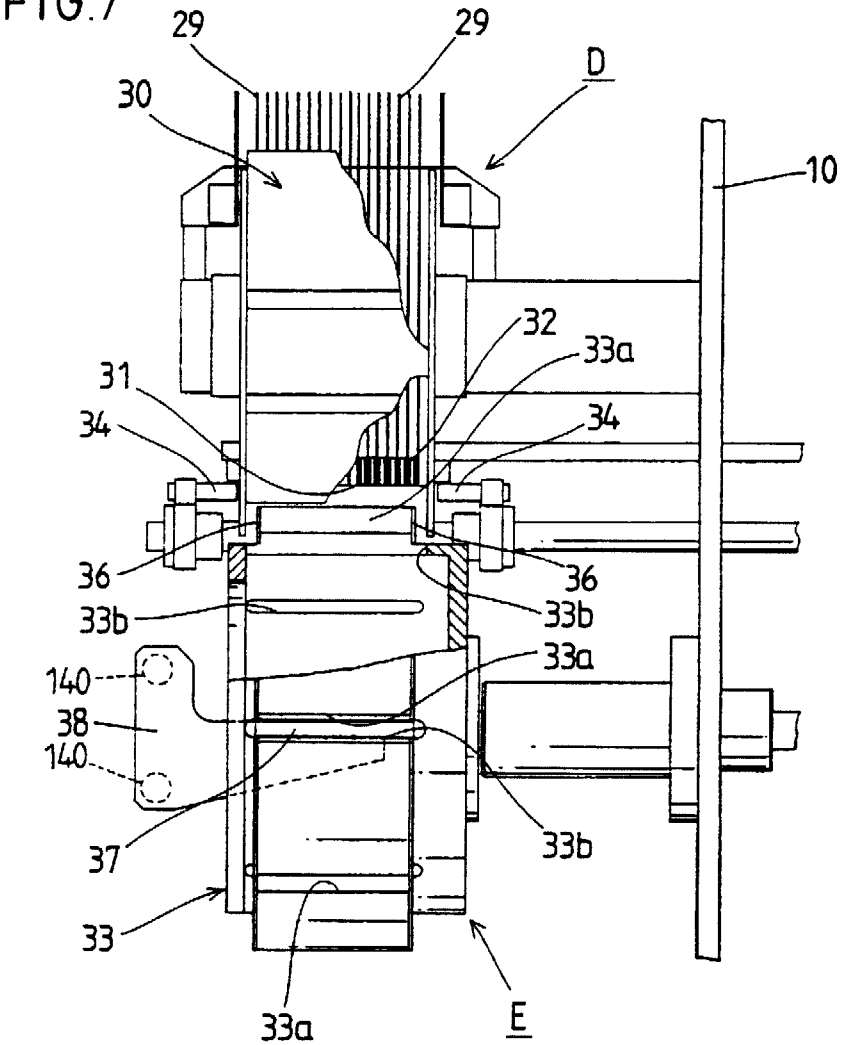
FIG. 7 is a partially cutaway side view of the major sections of the article introducing unit and of the article feeding unit in the assembly-packaging apparatus according to the embodiment.
Figure 8:
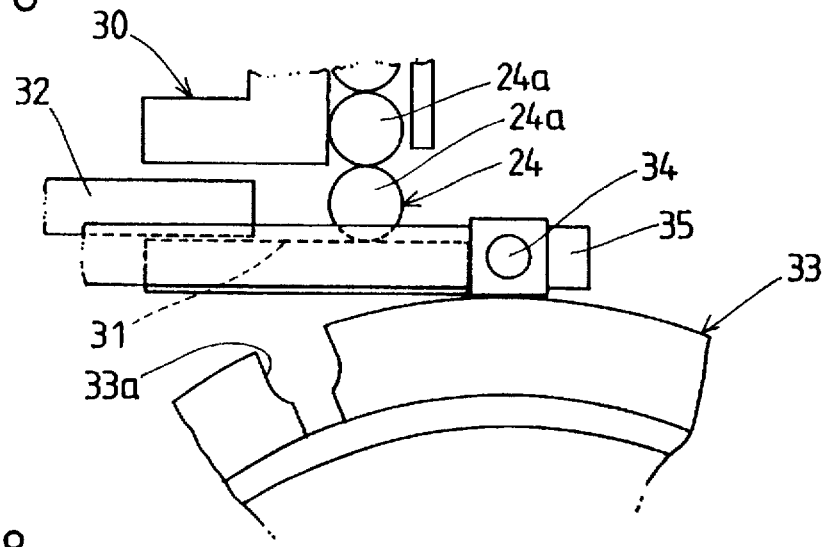
FIG. 8(*a*)–FIG. 8(*c*) are drawings for explaining actions of the article introducing unit according to the embodiment.
Figure 8:
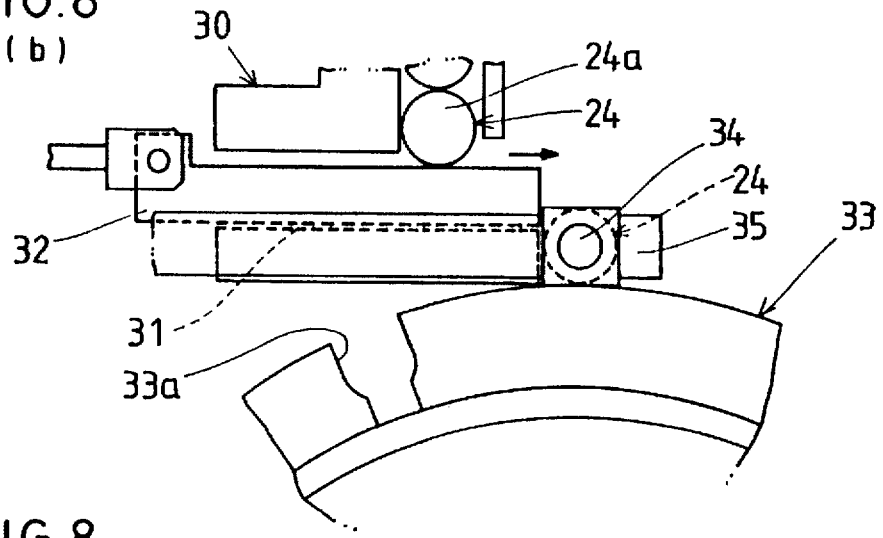
Figure 8:
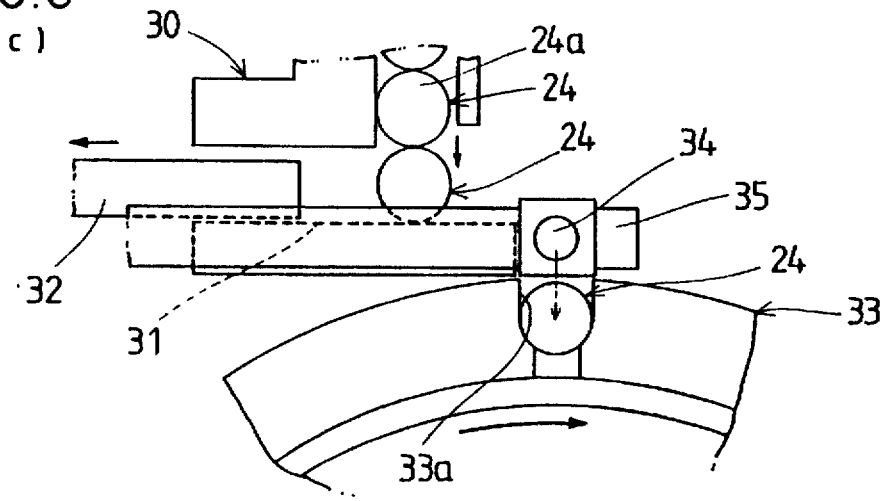

An article introducing unit (article introducing means) D is disposed in the frame 10 below the auxiliary slitting unit C, as shown in FIG. 1. The article introducing unit 10 introduces a plurality of pellet-like articles 24*a*, forwarded from a previous step (not shown), being aligned along the width of the packaging film F1. This article introducing unit D has a feeder chute 30 containing a plurality of partitions 29 spaced crosswise at predetermined intervals, as shown in FIG. 7, and pellet-like articles 24*a* supplied to the chute 30 are adapted to be crowded into each passage defined between every adjacent two partitions 29. A supporting plate 31 is disposed downstream the feeder chute 30 with respect to the article feeding direction, and the lowermost pellet-like articles 24*a* supplied to the chute 30 are supported on the supporting plate 31. Further, a pusher 32 which advances and retracts on the supporting plate 31 is disposed on the rear side of the chute 30, provided that the side of the chute 30 facing the film cutting section is the front side. This pusher 32 has a comb-like shape having slits formed to oppose the partitions 29 of the feeder chute 30, respectively, and is adapted to push a group of pellet-like articles 24*a* placed on the supporting plate 31 forward in the stroke that the pusher 32 is advanced along the upper surface of the supporting plate 31 from the rear side of the feeder chute 30, as shown in FIG. 8.

Below the supporting plate 31 is disposed a drum 33 constituting an article feeding unit E (to be described later) to be rotatable intermittently, and the pellet-like article group 24 pushed forward by the pusher 32 along the upper surface of the supporting plate 31 to be dropped therefrom is adapted to be transferred onto the outer circumference of the drum 33. A pair of inching members 34 are disposed to be spaced crosswise from each other and to oppose each other at the front end portion of the supporting plate 31. These inching members 34 are designed to be moved closer to and away from each other so that the pellet-like articles 24*a* dropped from the supporting plate 31 and transferred onto the outer circumference of the drum 33 may be brought tightly together in alignment with the end faces of the articles 24*a* being abutted against one another by moving these two inching members 34 closer to each other. Incidentally, a restricting member 35 is extended crosswise at a position spaced forward by a predetermined distance from the front end of the supporting plate 31, and the pellet-like article group 24 transferred onto the outer circumference of the drum 33 is adapted to be restricted by the restricting member 35 from moving in the circumferential direction of the drum 33.

(Article Feeding Unit)

An article feeding unit (article feeding means) E, for ejecting the group of pellet-like articles 24*a* fed, with the end faces thereof being abutted against one another in alignment, from the article introducing unit D as such toward the packaging film F1 locating at the stand-by position, is disposed below the unit D. The drum 33 of the article feeding unit E has one axial open end and also has a plurality of pockets 33*a* on the circumference thereof defined at predetermined intervals. Each pocket 33*a* is designed to have dimensions such that the group of pellet-like articles 24*a* aligned to be abutted against one another on the end faces may be received as such therein. When the drum 33 is rotated intermittently in the state where the pellet-like article group 24 is transferred onto the outer circumference of the drum 33, only the drum 33 rotates relative to the pellet-like article group 24 which is restricted from moving by the restricting member 35 to allow the article group 24 to be caught in a pocket 33*a* (see FIGS. 8(*b*),(*c*)). Incidentally, covers 36 are applied to each axial end of the drum 33 at the peripheral portions where the pockets 33*a* are defined so that each end of the pellet-like article group caught in the pocket 33*a* may be guided thereby. Meanwhile, the pusher 32 is designed to be actuated when a part of the circumference of the drum 33 present between the pockets 33*a* is passing under the section between the supporting plate 31 and the regulating member 35 to securely transfer the pellet-like article group 24 resting on the supporting plate 31 to the circumference of the drum 33, as shown in FIG. 8(*b*).

Figure 11:
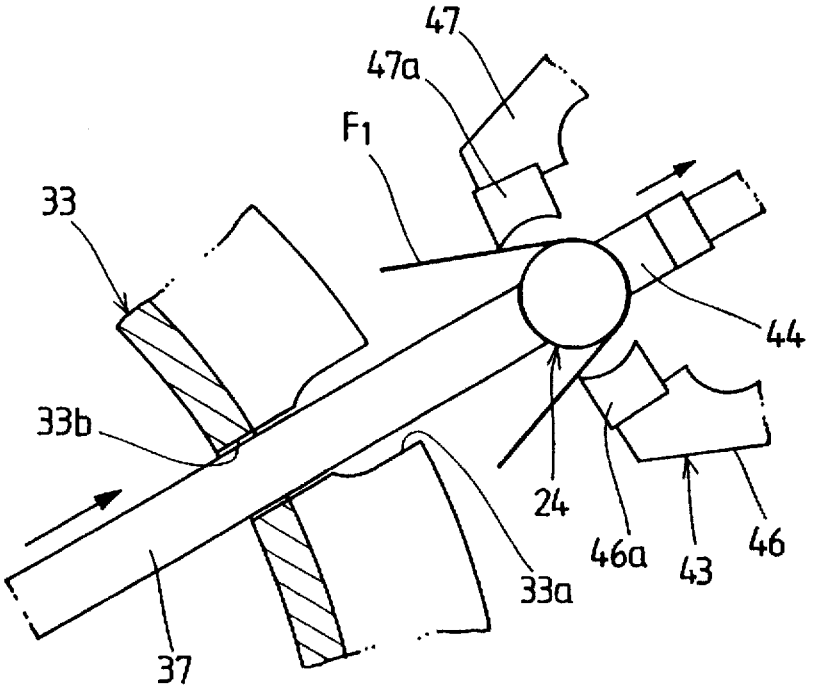
FIG. 11 is also a drawing for explaining an action of the article introducing unit according to the embodiment.
Figure 12:
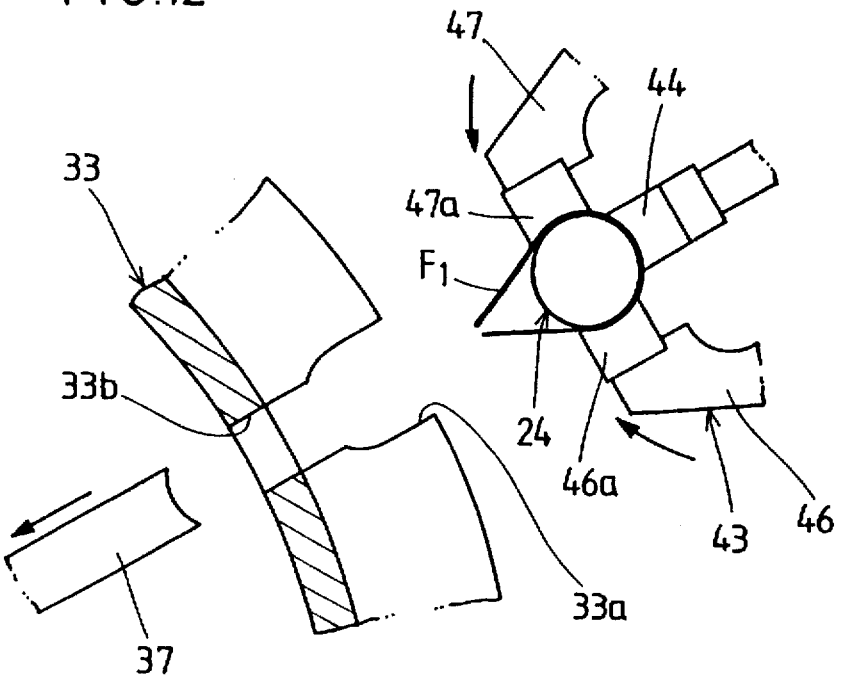
FIG. 12 is also a drawing for explaining an action of the article introducing unit according to the embodiment.

A slit 33*b* having a width smaller than the diameter of the pellet-like article group 24 is defined crosswise to open radially to the bottom of each pocket 33*a* of the drum 33, and an ejecting member 37 disposed in the drum 33 is designed to be advanced and retracted through the slit 33*b* coming to the position where it is opposed to the packaging film F1. More specifically, a pair of guide rods 140 are slidably disposed in support cylinders 141 provided in the frame 10 beside the open axial end of the drum 33. The guide rods 140 are extended orthogonal to the packaging film F1 at the stand-by position and are adapted to be advanced and retracted by the main drive source. A fitting member 38 is cantilevered across the ends of the guide rods 140 opposing the stand-by position, and the free end portion of the fitting member 38 is extended into the drum 33. The ejecting member 37 is mounted on this free end portion of the fitting member 38 extended into the drum 33, so that the ejecting member 37 may be reciprocated through the slit 33*b* between a retracted position (FIG. 9) in the drum 33 where it does not interfere with the rotation of the drum 33 and an ejecting position (FIG. 11) where it protrudes through the slit 33*b* outward from the drum 33 by advancing and retracting the guide rods (140) by the main drive source. The ejecting member 37 is adapted to be advanced from the retracted position to the ejecting position when the drum 33 is at pause to eject the aligned pellet-like article group 24 caught in the pocket 33*a* as such toward the packaging film F1 locating at the stand-by position and to transfer the pellet-like article group 24 wrapped with the film sheet F1 to an article holding unit G to be described later. Incidentally, the free end of the ejecting member 37 is arcuately recessed so that the pellet-like article group 24 may be supported stably thereon.

(Intermittent Rotor)

Figure 13:
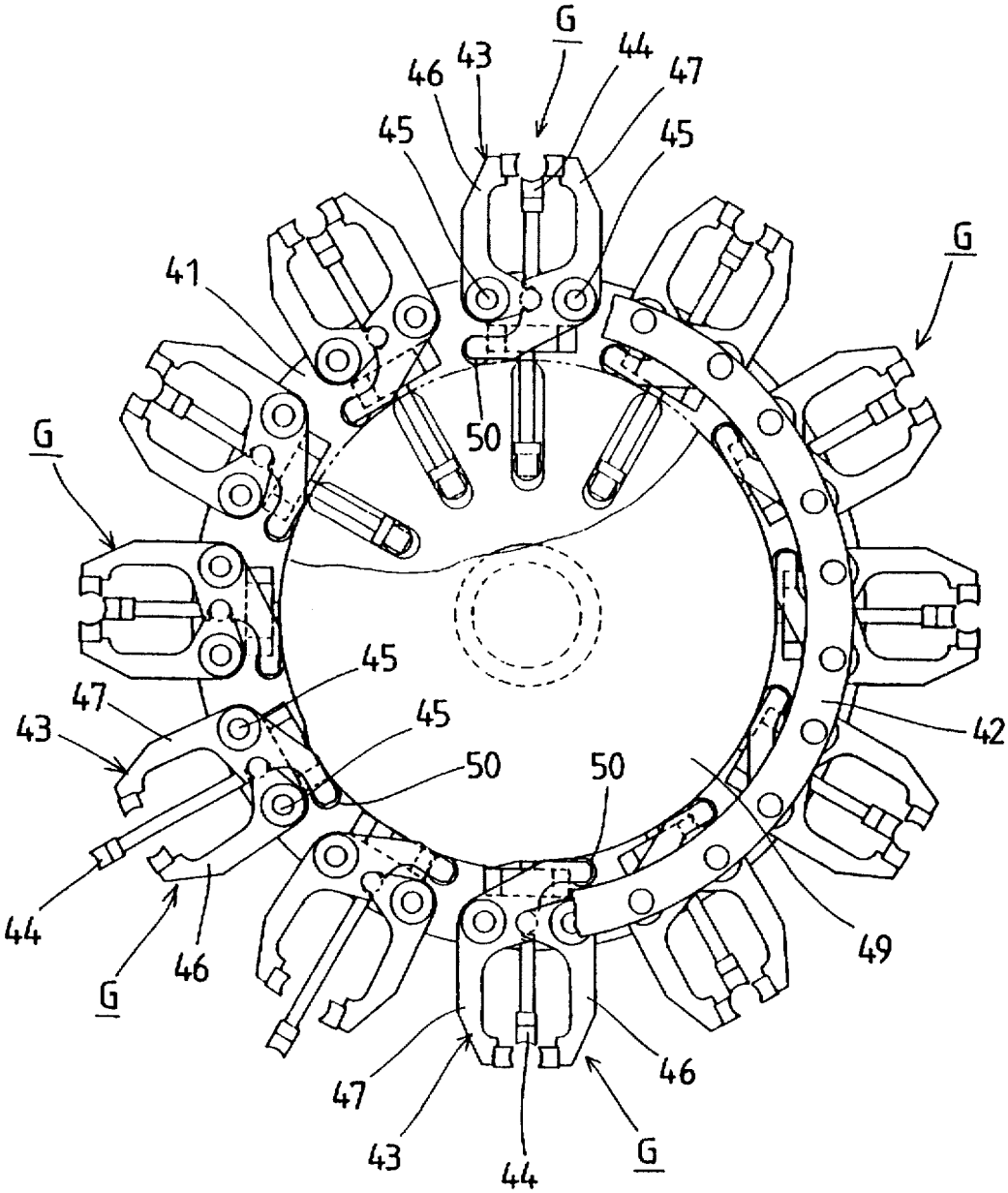
FIG. 13 is a front view of the major section of an intermittent rotor and an article holding unit in the assembly-packaging apparatus according to the embodiment.
Figure 14:
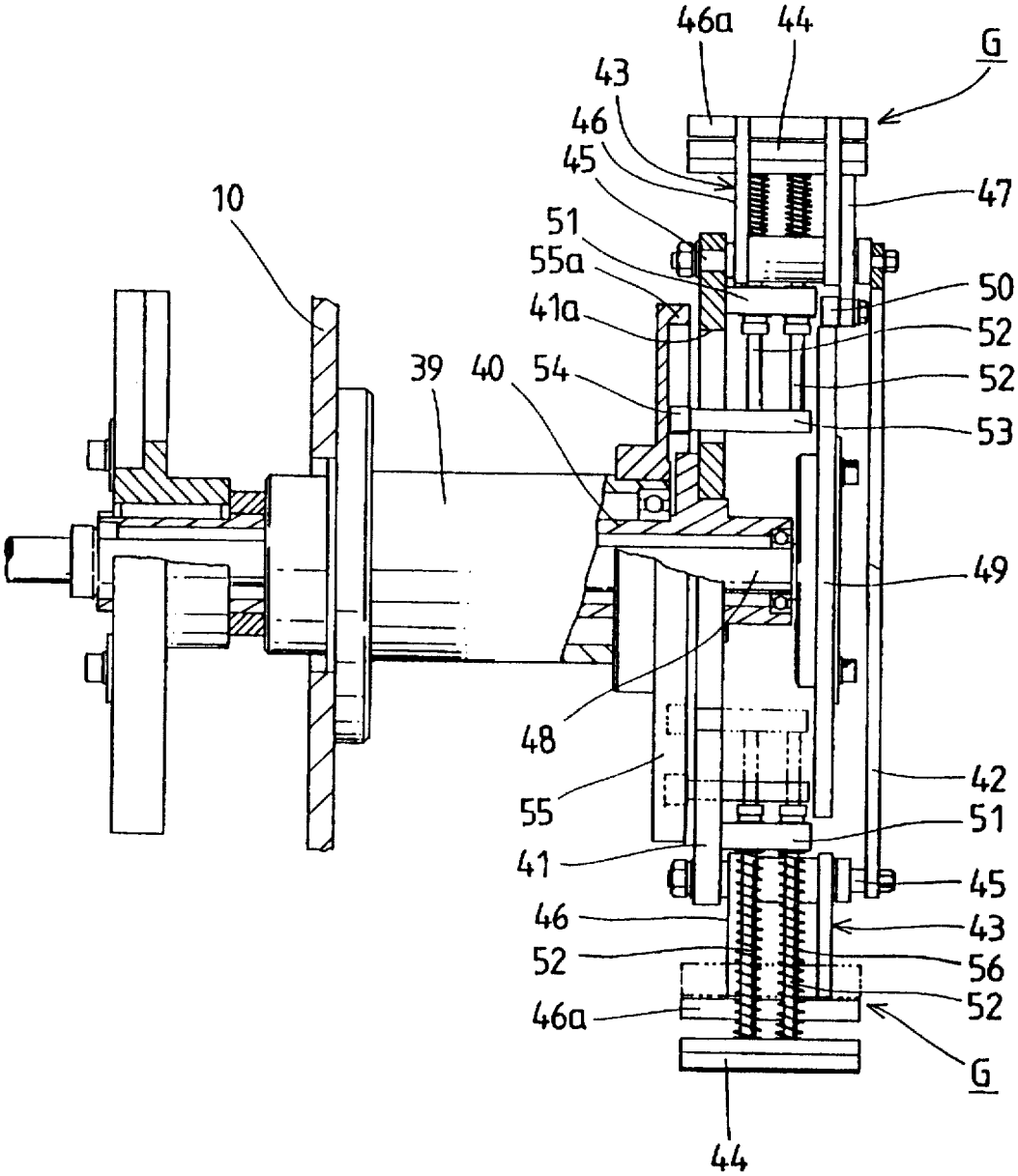
FIG. 14 is a partially cutaway side view of the major sections of the intermittent rotor and of the article holding unit according to the embodiment.

A cylindrical housing 39 is disposed in the frame 10 to be parallel to the rotational axis of the drum 33 on the opposite side across the stand-by position of the packaging film F1 from the drum 33, as shown in FIG. 14, and a hollow shaft 40 is rotatably supported in this housing 39. A disc-like intermittent rotor 41 is attached to the end portion of the hollow shaft 40 and protrudes forward from the housing 39 to be rotatable integrally with the shaft 40. A ring plate 42 which has substantially the same outer diameter as that of the rotor 41 is located parallel therewith to be spaced by a predetermined distance in the axial direction, and a plurality of article holding units G (twelve units in this embodiment) are supported between the intermittent rotor 41 and the ring plate 42 at predetermined phase angle intervals in the circumferential direction. The hollow shaft 40 is connected to intermittent rotational means (not shown) such as an indexing unit and a servo motor disposed on the rear side of the frame 10 and is adapted to be rotated intermittently clockwise by such means by predetermined angles (30° in this embodiment) in FIG. 13. Incidentally, on a line connecting the rotational center of the drum 33 and the axis of the hollow shaft 40, each pocket 33*a* of the drum 33 and each article holding unit G disposed on the intermittent rotor 41 are designed to be aligned and stopped intermittently, whereas the ejecting member 37 is adapted to advance and retract on that line.

(Article Holding Unit)

Each article holding unit (article holding means) G disposed between the intermittent rotor 41 and the ring plate 42 basically consists of a gripper 43 as means for gripping the pellet-like article group 24 ejected by the ejecting member 37 from the pocket 33*a* and half-wrapped with a packaging film F1 and a supporting member 44 for stably supporting the article group 24 when the article group 24 is to be gripped and released.

Figure 15:
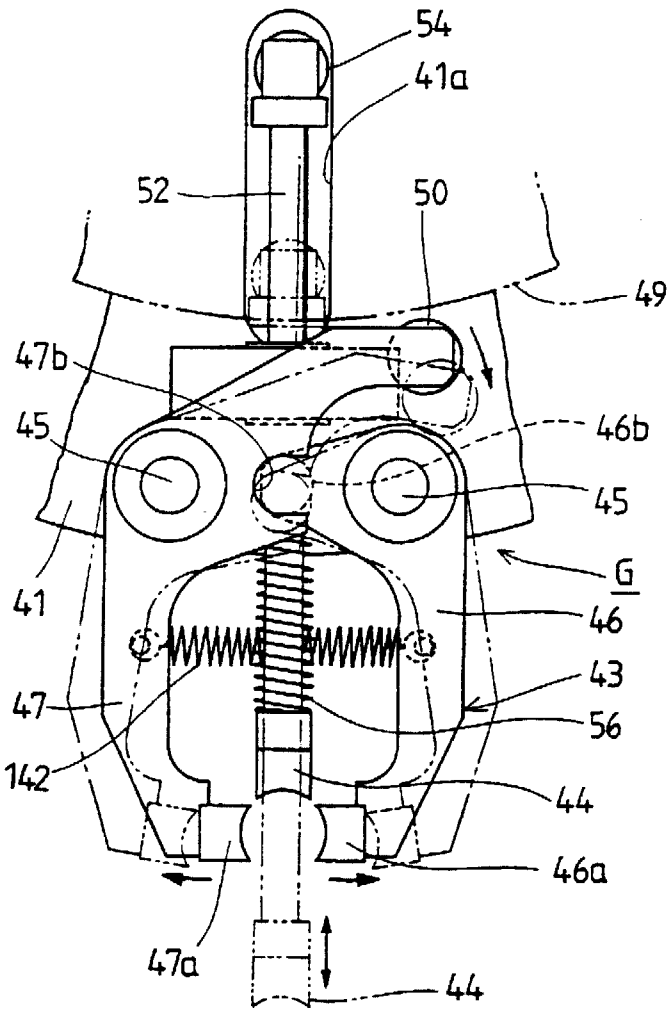
FIG. 15 is a front view of the article holding unit according to the embodiment.

As shown in FIGS. 13 and 15, the gripper 43 basically consists of a pair of gripping jaws 46,47 which are oscillatory supported respectively by a pair of pivotal shafts 45 disposed to be spaced from each other in the circumferential direction between the intermittent rotor 41 and the ring plate 42. The gripping jaws 46,47 have grabbing pieces 46*a*, 47*a*, which are substantially as long as the pellet-like article group 24, at that ends which extend outward in the radial direction of the intermittent rotor 41. Meanwhile, a follower 46*b* formed on one gripping jaw 46 is movably fitted in a recess 47*b* defined in the other gripping jaw 47, so that when one gripping jaw 46 is oscillated, the other gripping jaw 47 is oscillated interlocking with the jaw 46 to move the grabbing pieces 46*a*, 47*a* closer to and farther from each other.

An actuating shaft 48 is rotatably inserted to the center bore of the hollow shaft 40, and a gripper cam disc 49 is attached to the end portion of the actuating shaft 48 protruding from the hollow shaft 40 to be rotatable integrally with the shaft 48. Meanwhile, the gripping jaw 47 having the recess 47*b* has a cam follower 50 rotatably supported at the end portion opposing the hollow shaft 40, and the cam follower 50 is designed to be abutted against the cam face of the gripper cam disc 49. The cam follower 50 is adapted to move along the cam face of the gripper cam disc 49 to bring the grippers 43 to predetermined positions, and thus the grabbing pieces 46*a*, 47*a* of each pair of gripping jaws 46,47 are moved closer to or farther from each other to grip or release the pellet-like article group 24. At a closed position of the gripping jaws 46,47, they are designed to be urged by a spring 142 (see FIG. 15) toward dosing directions respectively to allow the cam follower 50 to be lifted slightly from the cam face.

The cam face of the gripper cam disc 49 has a releasing cam face where the grabbing pieces 46*a*, 47*a* of the pair of gripping jaws 46,47 are spaced from each other. The releasing cam face is defined over a zone where adjacent two grippers 43 arranged in the rotational direction of the intermittent rotor 41 are allowed to assume open postures. Provided that the gripper 43 locating at an article receiving position opposing the stand-by position of the packaging film F1 is the reference gripper, the releasing cam face is positioned at a site where only the reference gripper 43 and the adjacent upstream gripper 43 with respect to the rotational direction are allowed to assume open postures.

In this instance, the gripping jaws 46,47 locating at the article receiving position are maintained to assume the open posture under the cam action of the gripper cam disc 49 to bring the pellet-like article group 24 ejected by the ejecting member 37, together with the packaging film F1, between the grabbing pieces 46*a*, 47*a* of these gripping jaws 46,47. Therefore, in the constitution where the gripping jaws 46,47 assume the gripping state only when the gripper 43 is turned with respect to the gripper cam disc 49, the gripping jaws 46,47 can grip neither the pellet-like article group 24 nor the packaging film F1 when the gripper 43 leaves the article receiving position, so that the pellet-like article group 24 and the packaging film F1 slip off from the gripper 43. Accordingly, in this embodiment, the gripper cam disc 49 is designed to be turned within a predetermined range when the pellet-like article group 24 and the packaging film F1 are brought between the grabbing pieces 46*a*, 47*a* of the gripping jaws 46,47 locating at the article receiving position to allow them to assume the gripping state and to grip the pellet-like article group 24 together with the packaging film F1 therebetween.

More specifically, the actuating shaft 48 is designed to be turned within a predetermined angular range by a mechanism (not shown) disposed on the rear side of the frame 10, so that the gripper cam disc 49 may be turned via the actuating shaft 48 with the timing that the intermittent rotor 41 makes a pause. Accordingly, if the gripper cam disc 49 is turned counterclockwise by a predetermined angle in FIG. 13, when the pellet-like article group 24 and the packaging film F1 are brought between the grabbing pieces 46*a*, 47*a* of the gripping jaws 46,47, to move the releasing cam face of the cam disc 49 away from the article receiving position, the grabbing pieces 46*a*, 47*a* assuming the open posture are moved closer to each other in the direction orthogonal to the direction of ejecting the pellet-like article group 24 to assume the gripping posture and securely grip the pellet-like article group 24 and the packaging film F1. Thus, the pellet-like article group 24 and the packaging film F1 are prevented from slipping off from the grabbing pieces 46*a*, 47*a* when the article holding unit G is moved downstream as the intermittent rotor 41 is rotated intermittently. Incidentally, the gripper cam disc 49 is also designed to be turned clockwise with the timing that the intermittent rotor 41 is rotated intermittently to allow the releasing cam face to locate at the article receiving position.

Meanwhile, provided that the gripper 43 locating at the article receiving position is the reference gripper, the gripper 43 locating at the eleventh position counted downstream therefrom is designed to locate at the article releasing position (opposing the article receiving position of a carry-out conveyor O to be described later), so that the gripper 43 locating at the article releasing position may be switched from the gripping posture to the open posture, when the gripper cam disc 49 is turned to switch the gripper 43 locating at the article receiving position from the open posture to the gripping posture. More specifically, after the gripper 43 holding a package W wrapped with the packaging film F1 by sealing units (to be described later) is brought to the article releasing position and stopped there, the gripper 43 is allowed to resume the open posture to release the package W, and thus the package W is prevented from slipping off from the gripper 43 during the travel of the gripper 43.

Figure 16:
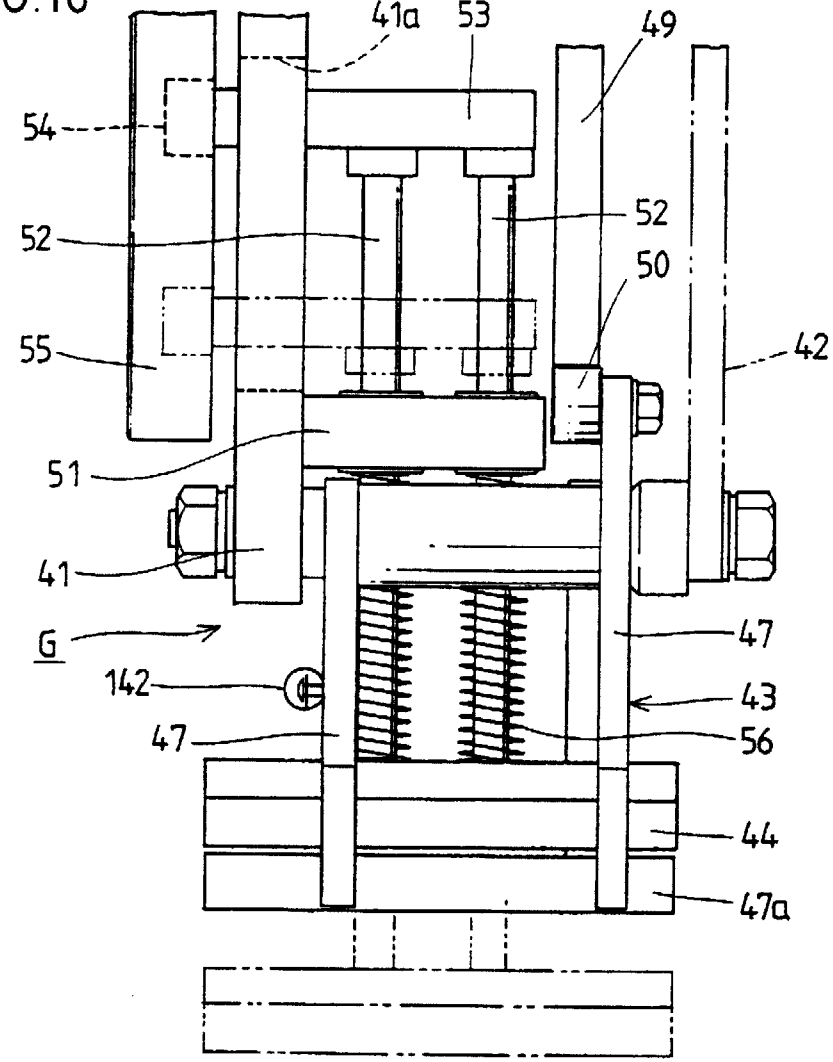
FIG. 16 is a side view of the article holding unit according to the embodiment.

A holder 51 protrudes, between the pivotal shafts 45 of each gripper 43, from the front surface of the intermittent rotor 41 opposing the ring plate 42, and a pair of supporting bars 52 are attached to this holder 51 to be slidable in the radial direction of the intermittent rotor 41. As shown in FIG. 16, a supporting member 44 which is as long as the grabbing piece 46*a* of the gripping jaw 46 is attached across the outer ends of the supporting bars 52, and the supporting member 44 is designed to be moved inward and outward in the radial direction of the intermittent rotor 41, between the gripping jaws 46,47 assuming the open posture (see FIGS. 9 to 12). Meanwhile, a pin 53 is attached to the inner ends of the supporting bars 52 opposing the hollow shaft 40 to be extended through a slot 41*a* defined in the rotor 41 in the radial direction at a corresponding position to protrude to the rear side thereof, with a cam follower 54 being supported rotatably to that protruding end portion of the pin 53. Further, a cam plate 55 for the supporting member is attached to the housing 39 supporting the hollow shaft 40 rotatably therein so that the cam follower 54 may be abutted against the cam face on the inner circumference of a flange 55*a* formed on the cam plate 55.

A compression spring 56 is resiliently fitted around each supporting bar 52 at a position between the supporting member 44 and the holder 51, and the supporting member 44 is normally urged under the resilience of the compression spring 56 to protrude outward through the clearance present between the gripping jaws 46,47. The cam face of the cam plate 55 for the supporting member is designed to bring the supporting members 44 locating at the article receiving position and at the article releasing position respectively to locate at positions where they protrude outward through the clearances defined between the respective gripping jaws 46,47 and also to bring other supporting members 44 in other zones to the retracted positions inner than the positions where pellet-like article groups 24 are gripped by the gripping jaws 46,47. The pellet-like article group 24 is designed to be gripped together with the packaging film F1 between the supporting member 44 locating at the extended position and the ejecting member 37, at the article receiving position (see FIGS. 10 and 11), whereas the package W is designed to be held between the supporting member 44 and a receiving member 113 (to be described later) at the article releasing position. It should be noted here that even when the supporting member 44 is at the retracted position, the pellet-like article group 24 gripped between the gripping jaws 46 and 47 is designed to be supported on the surface facing the hollow shaft 40. Further, in the process that the article holding unit G moves from the article releasing position to the article receiving position, the supporting member 44 is retracted once from the extended position to the retracted position, and thus the supporting member 44 is prevented from interfering with other members.

(First Sealing Unit)

Figure 17:
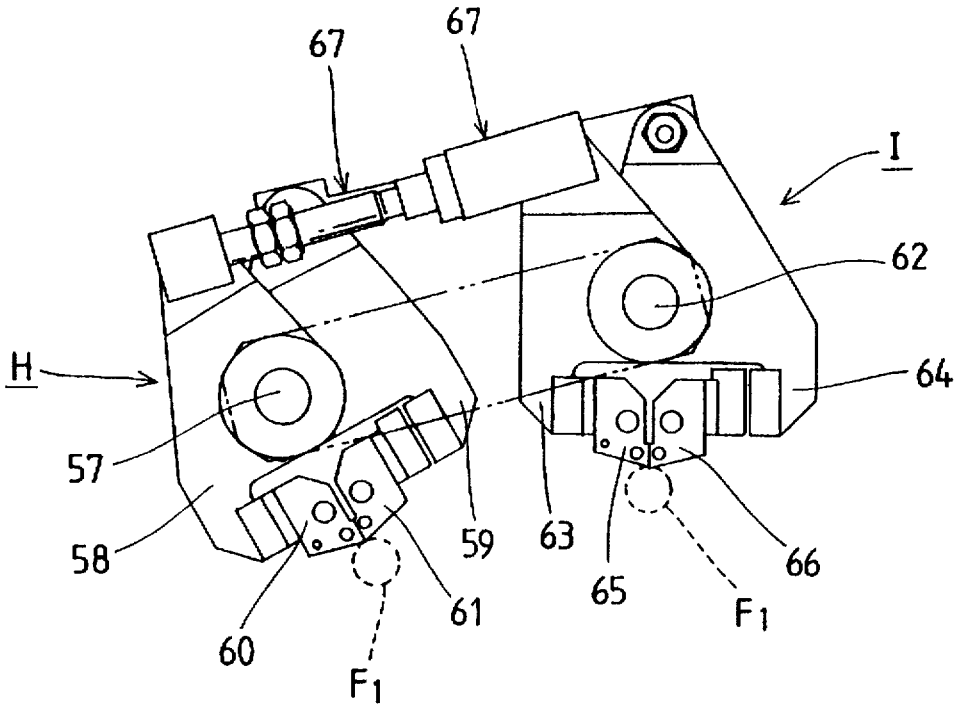
FIG. 17 is a front view of a first sealing unit and a second sealing unit in the assembly-packaging apparatus according to the embodiment which are assuming dosed postures.

A first sealing unit (first sealing means) H, which brings together the overlapping edges of the packaging film F1 half-wrapped around the pellet-like article group 24 held by the gripper 43 and applies preheat-sealing thereto, is disposed in the frame 10 adjacent to the outer circumference of the intermittent rotor 41 at a position deviated by the angle 60° from the article receiving position downstream with respect to the rotational direction of the rotor 41. This first sealing unit H consists of a pair of supporting plates 58,59 which are supported by a pivotal shaft 57 to be able to turn on the shaft 57 and a pair of sealers 60,61 attached to those ends of the supporting plates 58,59 which oppose the gripper 43, as shown in FIG. 17. The sealers 60,61 nip the overlapping edges of the packaging film F1 together and preheat-seal them to allow the packaging film F1 to have a tubular form. Incidentally, the length of the pair of sealers 60,61 is designed to be longer than the width of the packaging film F1 so that the overlapping edges of the packaging film F1 may be sealed over the entire width thereof.

(Second Sealing Unit)

A second sealing unit (second sealing means) I, which applies heat sealing to the overlapping edges preheat-sealed in the previous step, is disposed in the frame 10 at a position deviated by the angle 30* from the preheat-sealing position downstream with respect to the rotational direction of the intermittent rotor 41 (the next stopping position of the intermittent rotor 41). The constitution of this second sealing unit I is basically the same as that of the first sealing unit H and consists of a pair of supporting plates 63,64 which are supported by a pivotal shaft 62 to be able to turn on the shaft 62 and a pair of sealers 65,66 attached to those ends of the supporting plates 63,64 which oppose the gripper 43. The sealers 65,66 nip the preheat-sealed overlapping edges of the packaging film F1 therebetween and heat-seal them to form a sealed rib fa protruding outward in the radial direction of the pellet-like article group 24. Incidentally, the holding plates 58 and 59 in the first sealing unit H and the holding plates 64 and 63 of the second sealing unit I are designed to be linked by connecting rods 67, respectively, so that the packaging films F1 coming to these sealing units H,I may be sealed respectively by a driving mechanism (not shown) with the timing that the intermittent rotor 41 makes a pause.

(Slitting Unit)

Figure 20:
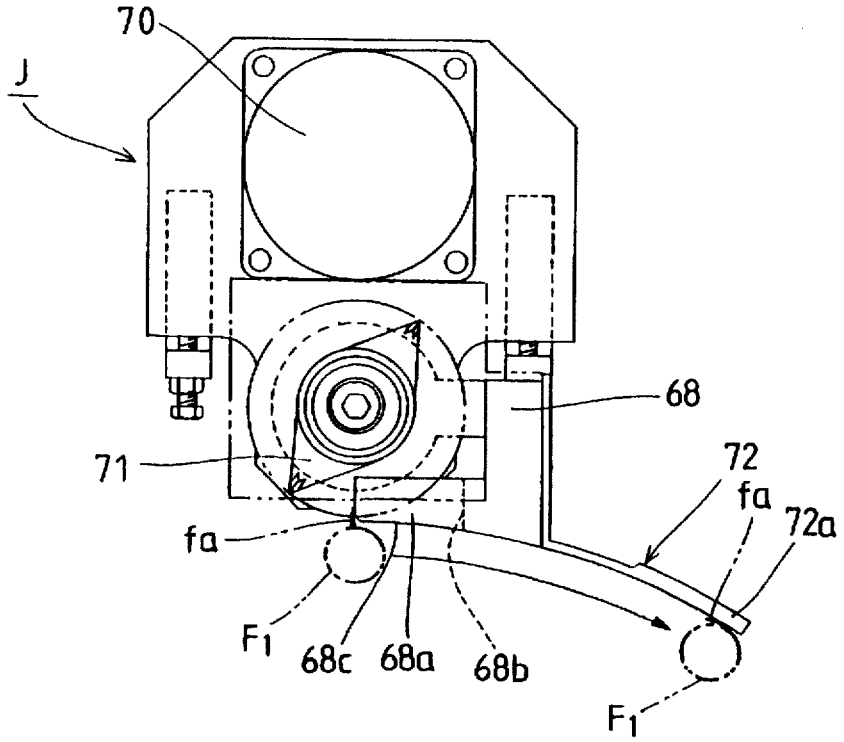
FIG. 20 is a front view of the slitting unit according to the embodiment.

A slitting unit (slitting means) J, which forms a plurality of slits s for opening the package at the sealed rib fa, is disposed in the frame 10 at a position deviated by the angle 30° from the heat-sealing position downstream with respect to the rotational direction of the rotor 41 (the next stopping position of the intermittent rotor 41). This slitting unit J has a reversed L-shaped support 68 on the route that the sealed rib fa of the packaging film F1 wrapped around the pellet-like article group 24 held by the gripper 43 travels, as shown in FIG. 20, and this support 68 is designed to support on the free end thereof the downstream side of the sealed rib fa. The horizontal portion 68*a* of the support 68 contains a plurality of vacant spaces 68*b* defined at predetermined intervals along the width of the packaging film F1. These vacant spaces permit intrusion of cutting blades 71 (to be described later) to form tearing slits s at the sealed rib fa supported on the horizontal portion 68*a*.

Figure 44:
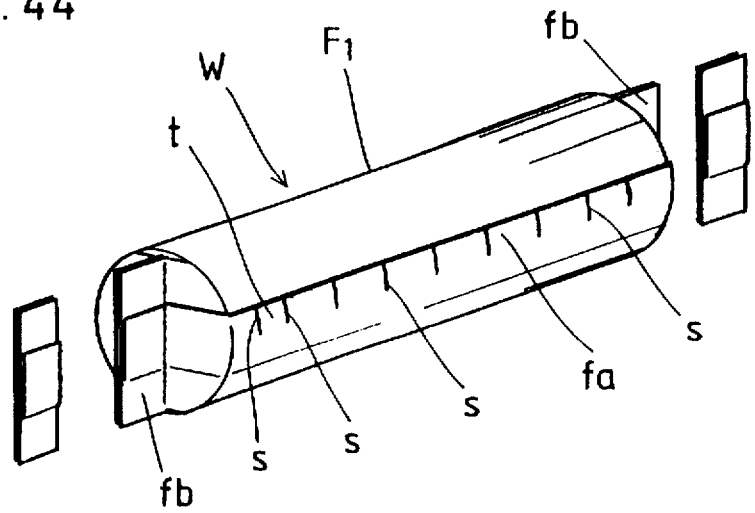
FIG. 44 is an explanatory drawing showing a step in the process that the pellet-like article group is wrapped with the packaging film by the assembly-packaging apparatus according to the embodiment.

A drive shaft 69 is rotatably supported in the frame 10 above the support 68 (to oppose the intermittent rotor 41 across the support 68) to be parallel to the hollow shaft 40. This drive shaft 69 is adapted to be rotated intermittently by a drive motor 70 disposed in the frame 10. Meanwhile, a plurality of cutting blades 71 are disposed, on that portion of the drive shaft 69 which protrude forward from the frame 10, at predetermined intervals in the axial direction to be rotatable integrally with the shaft 69. The cutting blades 71 are positioned to oppose the vacant spaces 68*b* of the support 68, respectively. Each cutting blade 71 has a substantially rhombic form, and tearing slits s are formed at the sealed rib fa of the packaging film F1 in the process that the longer edges protruding radially intrude into the vacant spaces 68*b* of the support 68. Incidentally, the cutting blades 71 are attached to the drive shaft 69 such that the protruding directions of the longer edges may be deviated from one another by a predetermined angle in the circumferential direction, so that tearing slits s may be formed successively crosswise in the process that the shaft 69 is rotated. The distance between the first two cutting blades 71 disposed adjacent to one end of the shaft 69 is designed to be smaller than those between other cutting blades 71, and a tongue t (see FIG. 44) between the slits s formed by these first two cutting blades 71 is used for opening the packaging film F1. After a necessary number of pellet-like articles 24*a* are taken out of the package W opened by pulling off the tongue t, the other tearing slits s are used for further tearing off the packaging film F1 wrapping the pellet-like article group 24 therein.

Figure 46:
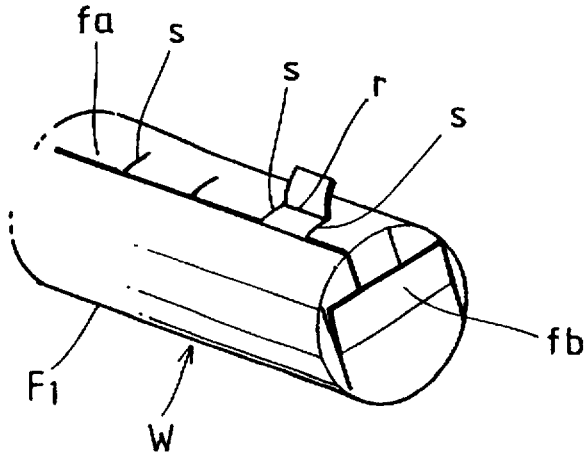
FIG. 46 is an explanatory drawing showing a state where the package formed by the assembly-packaging apparatus according to the embodiment of the invention is opened by pulling off a tongue.

An auxiliary slit r formed by the auxiliary slitting unit C on one longitudinal edge of the packaging film F1 opposing the barrel of the pellet-like article group 24 is adapted to appear at the root of this tongue t, when the sealed tab fb is pulled down along the barrel of the pellet-like article group 24 by a folding guide 72 to be described later (see FIG. 46). This auxiliary slit r intersects with the two tearing slits s defining the tongue t. Since two sheets of film are sealed together at the tearing start end of the tongue t, the tongue t is prevented from breaking by the tearing force applied when the packaging film F1 is opened by pulling off the tongue t, and only one sheet is torn being guided by the slit r, facilitating opening of the package W.

(Folding Guide Means)

The supporting plate 68 has a lower surface (the face opposing the gripper 43) 68*c* arcuated along a circle drawn around the axis of the intermittent rotor 41 to serve also as folding guide means for folding the sealed rib fa having slits s formed thereon along the barrel of the pellet-like article group 24. A substantially L-shaped folding guide 72 having arcuate portions 72*a* is disposed downstream the support 68. The arcuated portions 72*a* of this guide 72, like the lower surface 68*c* of the supporting plate 68, also function as folding guide means for folding the slitted sealed rib fa along the barrel of the pellet-like article group 24. More specifically, when the gripper 43 is turned by the intermittent rotor 41 from the location of the slitting unit J to the next position, the sealed rib fa is moved being abutted against the lower surface 68*c* of the supporting plate 68 and the lower surfaces (the surface opposing the gripper 43) of the arcuate portions 72*a* in the folding guide 72, and thus the sealed rib fa is folded down along the barrel of the pellet-like article group 24. Incidentally, the arcuate portions 72*a* are arcuated along a circle drawn around the axis of the intermittent rotor 41. Further, the arcuate portions 72*a* are extended from the slitting position to the location of a third sealing unit K (to be described later) deviated downstream from the slitting position by the angle 30* to prevent the sealed rib fa from being lifted from the barrel before it is sealed by the third sealing unit K.

(Third Sealing Unit)

Figure 22:
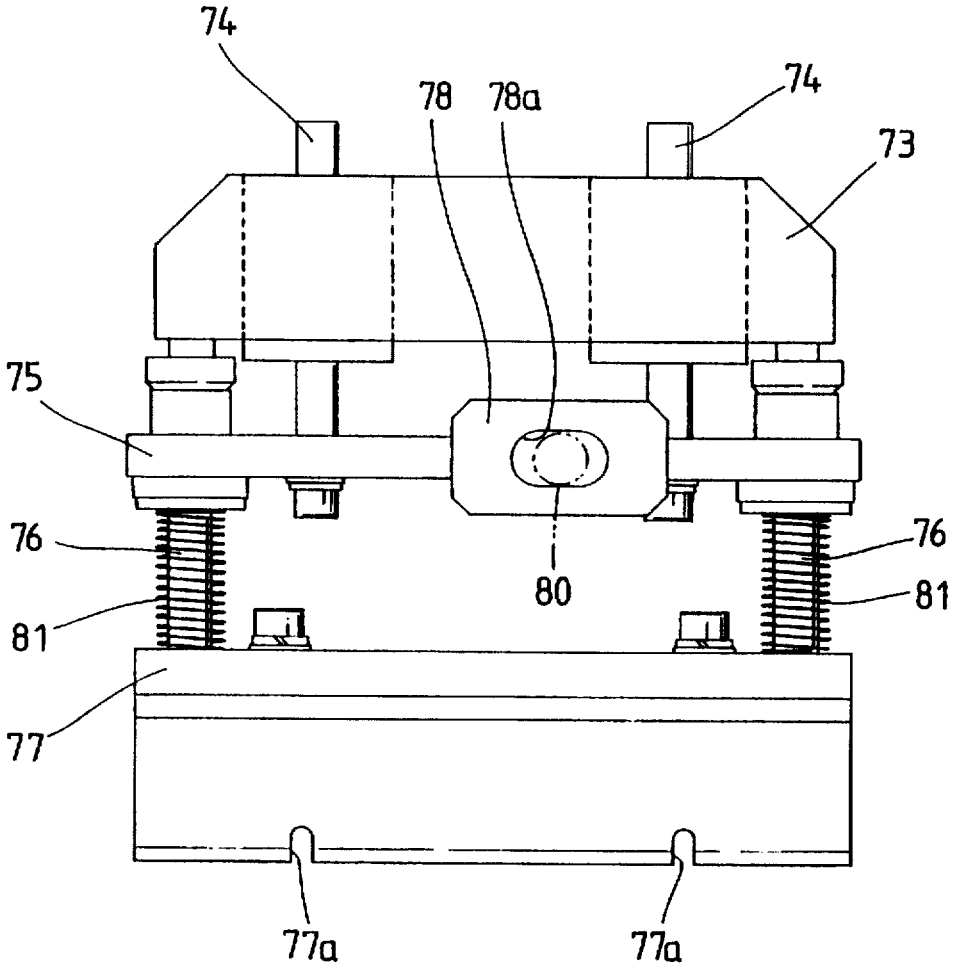
FIG. 22 is a side view of the third sealing unit according to the embodiment.

A third sealing unit (third sealing means) K, which heat-seals the sealed rib fa folded by the folding guide 72 onto the opposing portion of the packaging film F1 present on the barrel of the pellet-like article 24, is disposed in the frame 10 at a position deviated from the slitting position by the angle 30* downstream with respect to the rotational direction of the intermittent rotor 41 (at the next stopping position of the intermittent rotor 41). This third sealing unit K has a pair of slide shafts 74 slidably fitted to a bracket 73 fixed to the frame 10 to be spaced away from each other along the width of the packaging film F1 so that the shafts 74 may be moved closer to and away from the axis of the hollow shaft 40, as shown in FIG. 22. A holder 75 is extended across that end portions of the slide shafts 74 which oppose the hollow shaft 40 to be movable integrally with the shafts 74, with a pair of guide rods 76 being attached to this holder 75 to be spaced from each other along the width of the packaging film F1 and to be movable closer to and away from the axis of the hollow shaft 40. A heat-sealing bar 77 having a sealing surface opposing the axis of the hollow shaft 40 is extended across that ends of these guide rods 76 which oppose the hollow shaft 40. This heat-sealing bar 77 is extended over the entire length of the packaging film F1, and the sealing surface of the heat-sealing bar 77 is designed to be abutted against the sealed rib fa of the packaging film F1 held by the gripper 43, when the holder 75 is moved closer toward the axis of the hollow shaft 40, so that the sealed rib fa may be heat-sealed onto that portion of the packaging film F1 present on the barrel. Meanwhile, the heat-sealing bar 77 has escape grooves 77*a* for receiving the folding guide 72, so that the guide 72 may extend through these escape grooves 77*a* downstream beyond the position where the sealed rib fa is sealed. Incidentally, the sealing surface of the heat-sealing bar 77 is arcuated along the curve of the barrel of the pellet-like article group 24.

An operating plate 78 containing a slot 78*a* is fitted to the holder 75, and a follower 80 eccentrically provided on an operating shaft 79 of a gussetting and sealing unit L (to be described later) is slidably fitted in this slot 78*a*. More specifically, the holder 75 is moved along the bracket 73 via the follower 80 when the operating shaft 79 is turned, and thus the heat-sealing bar 77 can be moved closer to and farther from the axis of the hollow shaft 40. Incidentally, a compression spring 81 is resiliently fitted around each guide rod 76 locating between the holder 75 and the heat-sealing bar 77 to normally urge the heat-sealing bar 77 to be spaced away from the holder 75.

(Gussetting and Sealing Unit)

Figure 21:
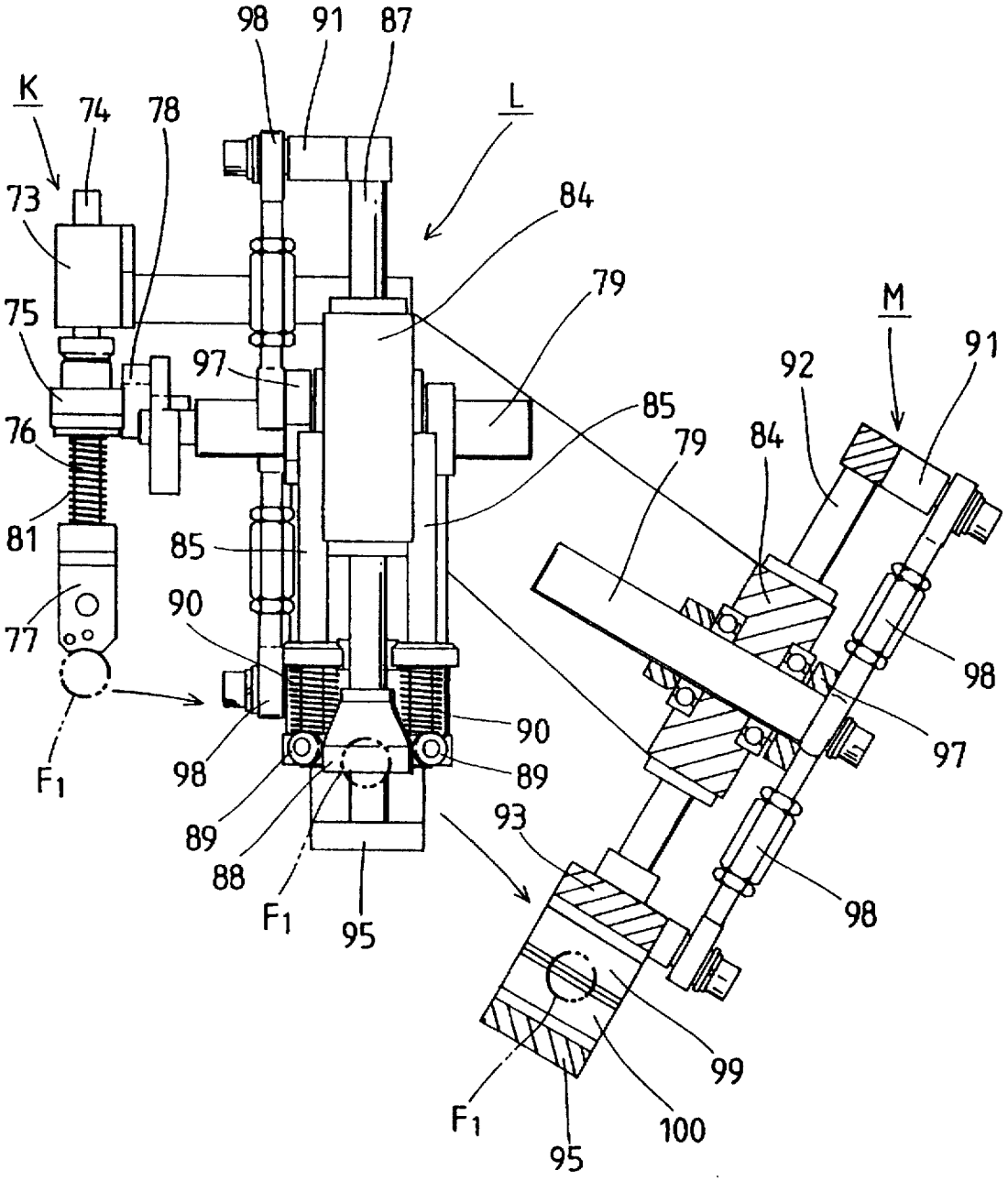
FIG. 21 is a front view of the major sections of a third sealing unit, a gussetting and sealing unit and a fourth sealing unit in the assembly-packaging apparatus according to the embodiment.

A gussetting and sealing unit (gussetting and sealing means) L consisting of a gussetter 82 which gussets each open end portion of the tubular packaging film F1 wrapped around the pellet-like article group 24 and a partial sealer 83 for partially sealing (preheat-sealing) the gussetted portions is disposed in the frame 10 at a position spaced downstream from the sealing position of the sealed rib fa (the next stopping position of the intermittent rotor 41). More specifically, two pairs of pivotal pins 85 are attached to a housing 84 fixed to the frame 10 on the upstream side and on the downstream side to protrude downward on each end of the tubular packaging film F1 wrapping therein the pellet-like article group 24 held by the gripper 43, as shown in FIG. 21. A pair of gussetting pawls 86 are pivotally supported at the lower ends of each pair of pivotal pins 85, so that the open end portions of the packaging film F1 may be folded inward by moving the distal end portions of the pair of gussetting pawls 86 opposing the pellet-like article group 24 closer to each other.

Figure 23:
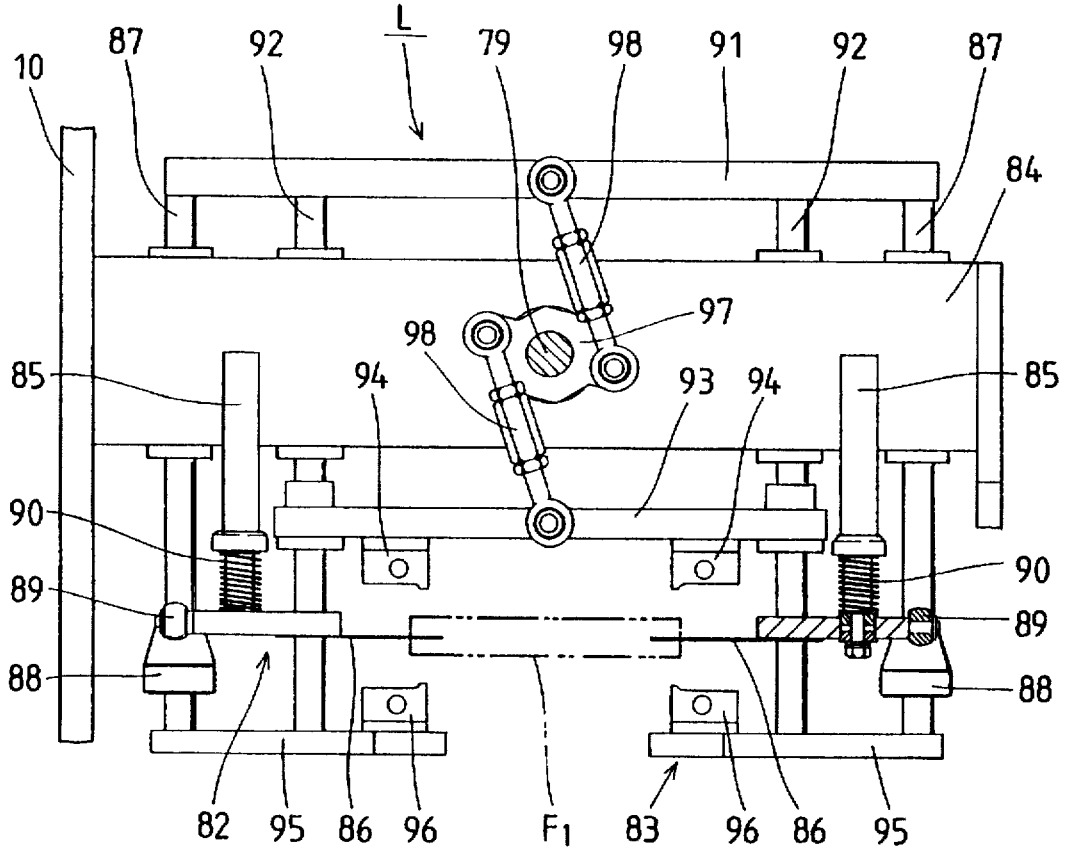
FIG. 23 is a side view of the gussetting and sea ling unit according to the embodiment assuming an open posture.

As shown in FIG. 23, a pair of first slide shafts 87 are slidably disposed in the housing 84 at positions outer than the pivotal pins 85 to be spaced from each other in the longitudinal direction, and a cam 88 having a tapered portion on the circumference thereof is attached to each first slide shaft 87 near the lower end portion protruding downward from the housing 84. A pair of rollers 89 attached to the rear end portions of each pair of gussetting pawls 86 are adapted to be abutted against the circumference of the corresponding cams 88. Coiled springs 90 are fitted around the pivotal pins 85 to normally urge the rollers 89 of the pair of gussetting pawls 86 to be abutted against the tapered surfaces of the cam 88, respectively. It should be noted that the front end portions of each pair of gussetting pawls 86 are designed to be moved away from each other in the state where the rollers 89 are abutted against the small-diameter portion of the cam 88 and to be moved closer to each other by moving the first slide shafts 87 relative to the housing 84 by a mechanism (to be described later) to bring large-diameter portions of the cams 88 in abutment with the rollers 89, respectively (see FIGS. 25 and 26).

Figure 24:
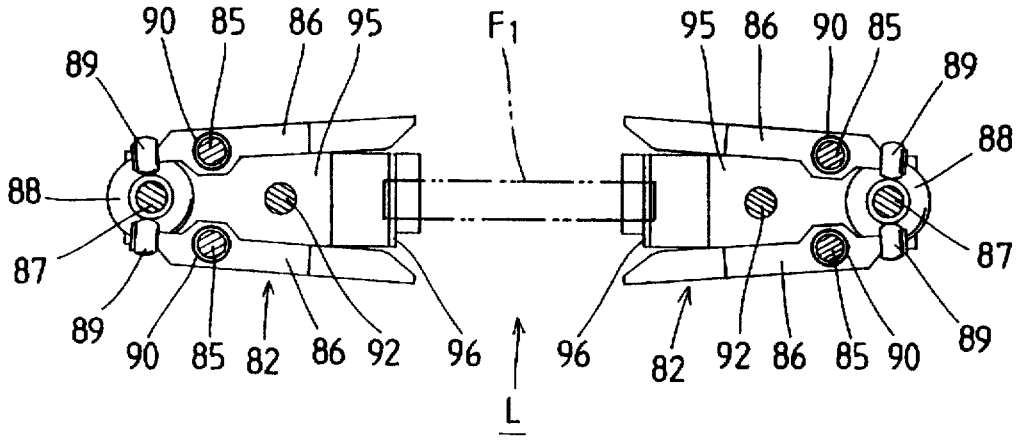
FIG. 24 is a horizontal cross-sectional plane view of the gussetting and sealing unit according to the embodiment assuming the open posture.

A joint 91 is extended across the upper end portions of the first slide shafts 87, and a pair of second slide shafts 92 disposed slidably in the housing 84 are fixed at the upper ends to the joint 91 to be spaced from each other between the first slide shafts 87. An upper sealer holder 93 is slidably extended across those portions of the second slide shafts 92 protruding downward from the housing 84, and a pair of upper sealers 94 are attached to the lower surface of the upper sealer holder 93 to be spaced from each other in the longitudinal direction. Meanwhile, a lower sealer holder 95 is extended across the lower ends of the first slide shaft 87 and of the second slide shaft 92 which are locating outer than each upper sealer 94, and a pair of lower sealers 96 to be opposed to the upper sealers 94 are attached onto the upper surfaces of the lower sealer holders 95, respectively. Further, the operating shaft 79 is rotatably supported in the housing 84, and a pair of turnbuckles 98 are pivotally supported each at one end on a lever 97, fixed on the shaft 79, across the operating shaft 79 from each other. The other end of one turnbuckle 98 is pivotally supported on the joint 91, and that of the other turnbuckle 98 is pivotally supported on the upper sealer holder 93. More specifically, the joint 91 and the upper sealer holder 93 are moved closer to and farther from each other via the turnbuckles 98, as shown in FIGS. 23 and 24, by turning the operating shaft 79 in the positive and negative directions by driving means (not shown). Simultaneously, the upper sealer holder 93 and the lower sealer holders 95 are moved closer to and farther from each other, and the open end portions of the tubular packaging film F1 are adapted to be partially sealed when the upper sealers 94 are abutted against the lower sealers 96. It should be noted here that when the joint 91 is moved so as to bring the sealers 94 and 96 in abutment with each other, the rollers 89 of each pair of gussetting pawls 86 having been abutted against the small-diameter portion of the cam 88 attached to the first slide shaft 87 fixed to the joint 91 are designed to be brought into abutment against the large-diameter portion to achieve gussetting of the open end portions of the packaging film F1.

The upper and lower sealers 94,96 are adapted to nip each open end portion of the packaging film F1 substantially at the center in the dosing stroke of the pair of gussetting pawls 86 to seal the two-sheet overlapping portion of the open end portion. Escape cavities, for receiving therein each pair of gussetting pawls 86 are defined on the opposing surfaces of the upper and lower sealers 94,96 at such sites as they are present when the sealers 94 and 96 are abutted against each other, so that the gussetting pawls 86 may not interfere with the sealers 94,96. Further, the follower 80 inserted to the slot 78*a* of the operating plate 78 in the third sealing unit K is eccentrically attached to the end of the operating shaft 79, so that the sealed rib fa may be heat-sealed onto the barrel of the tubular packaging film F1 by the third sealing unit K when the operating shaft 79 is turned in the direction of achieving gussetting and partial sealing of the open end portions of the packaging film F1.

(Fourth Sealing Unit)

A fourth sealing unit (fourth sealing means) M, which seals the open end portions of the packaging film F1 gussetted and partially sealed by the gussetting and sealing unit L, is disposed in the frame 10 at a position spaced downstream from the gussetting and sealing position in the rotational direction of the intermittent rotor 41 (the next stopping position of the intermittent rotor 41). Since the constitution of this fourth sealing unit M is basically the same as that of the partial sealer 83 in the gussetting and sealing unit L, the similar parts are affixed with the same reference numbers respectively, and detailed description of them will be omitted. It should be noted, however, that an upper sealer 99 and a lower sealer 100 are designed to nip entirely the open end portions of the packaging film F1 when they are moved closer to each other and seal them fully to form sealed tabs fb.

The gussetting and sealing unit L and the fourth sealing unit M are positioned to be deviated at predetermined angles with respect to the axis of the hollow shaft 40, as shown in FIG. 1, so that the sealed tabs fb may be formed on each end portion of the packaging film F1 to be orthogonal to the perpendicular line passing the longitudinal center line of the sealed rib fa. More specifically, in the packaging film F1 held by the gripper 43, the root of the folded sealed rib fa is located on the radial line passing the axis of the hollow shaft 40 and the axis of the pellet-like article group 24. Accordingly, if the gussetting and sealing unit L and the fourth sealing unit M are arranged in alignment with such radial line, the sealed tabs fb are formed to be orthogonal to the perpendicular line passing the root of the folded sealed rib fa and the axis of the pellet-like article group 24, and thus locations of the sealed tabs fb and the sealed rib fa are not well-balanced to provide poor appearance. Therefore, the gussetting and sealing unit L and the fourth sealing unit M are arranged at predetermined angles deviated from the axis of the hollow shaft 40 as in the preferred embodiment so as to form the sealed tabs fb to be orthogonal to the perpendicular line passing the longitudinal center line of the sealed rib fa, improving appearance.

(Sealed Tab Cutting Unit)

Figure 27:
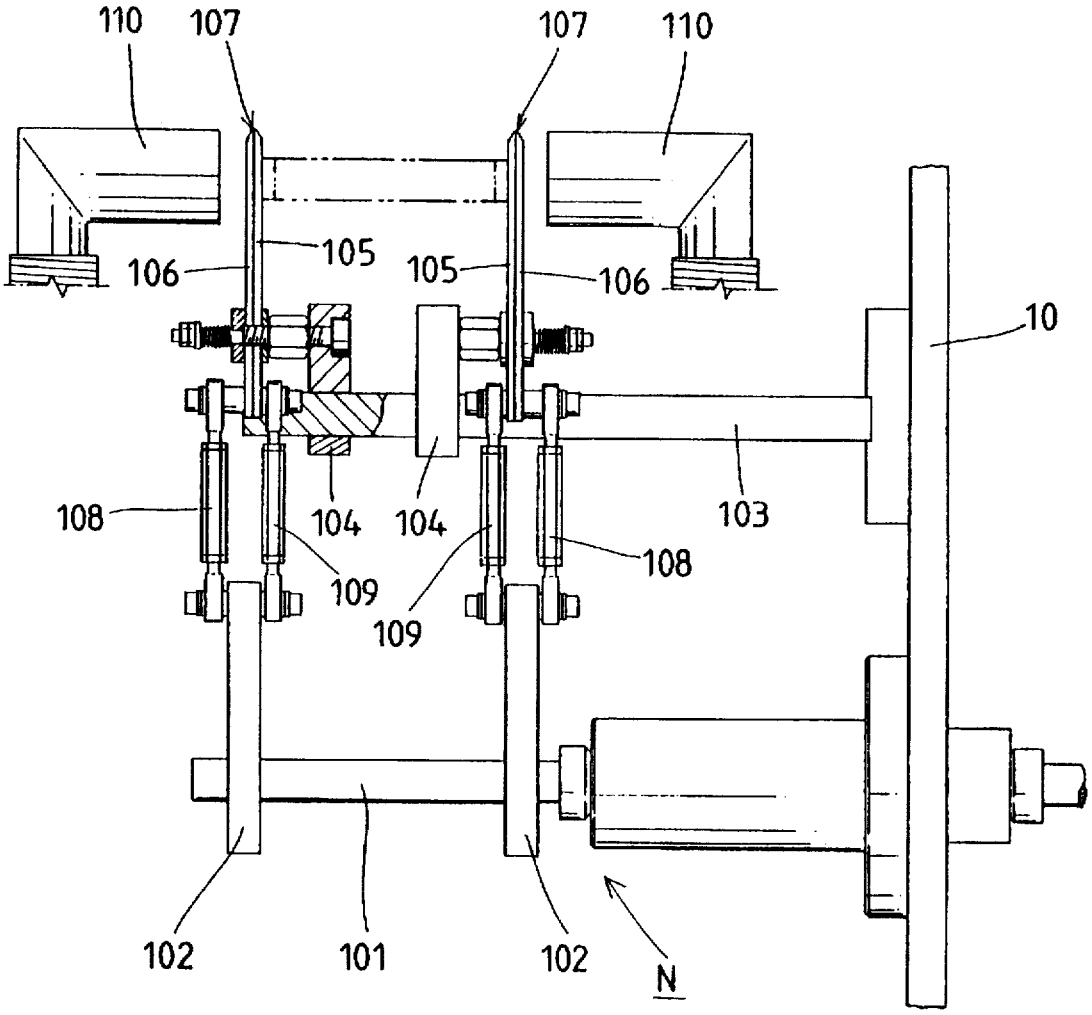
FIG. 27 is a side view of the major section of a sealed tab cutting unit in the assembly-packaging apparatus according to the embodiment.

A sealed tab cutting unit (sealed tab cutting means) N, for cutting off the sealed tabs fb by a predetermined length, is disposed in the frame 10 at the next stopping position of the intermittent rotor 41 spaced downstream from the position where the open end portions of the packaging film F1 are to be sealed. More specifically, an operating shaft 101 is rotatably supported on the frame 10 to be parallel to the hollow shaft 40, and a pair of levers 102 are attached to the operating shaft 101 at the portion protruding toward the front side of the frame 10 to be spaced from each other in the axial direction of the shaft 101 and to be rotatable integrally with the shaft 101, as shown in FIG. 27. Further, a holder 103 is also fixed to the frame 10 to be spaced from the operating shaft 101, and a pair of brackets 104 are fixed to this holder 103 to be spaced from each other in the direction that the levers 102 are spaced. A cutter 107 consisting of a pair of knives 105 and 106 is pivotally supported on each bracket 104. The cutting edges in each cutter 107 are locating at positions where they can cut the sealed tabs fb of the packaging film F1 held by the gripper 43, respectively.

Figure 28:
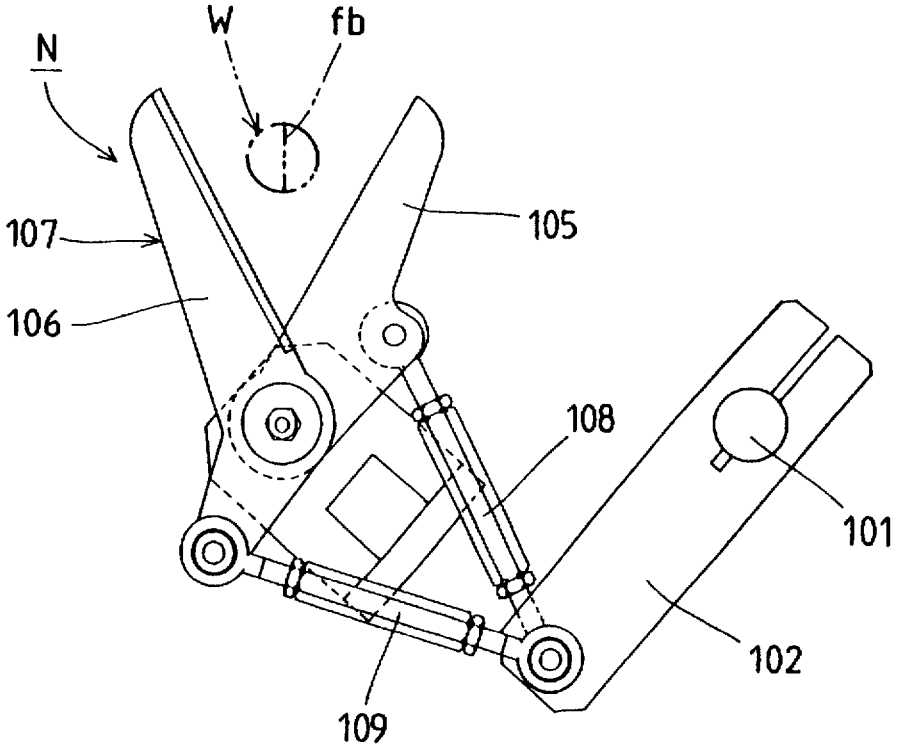
FIG. 28 is a front view of the sealed tab cutting unit according to the embodiment assuming an open posture.
Figure 29:
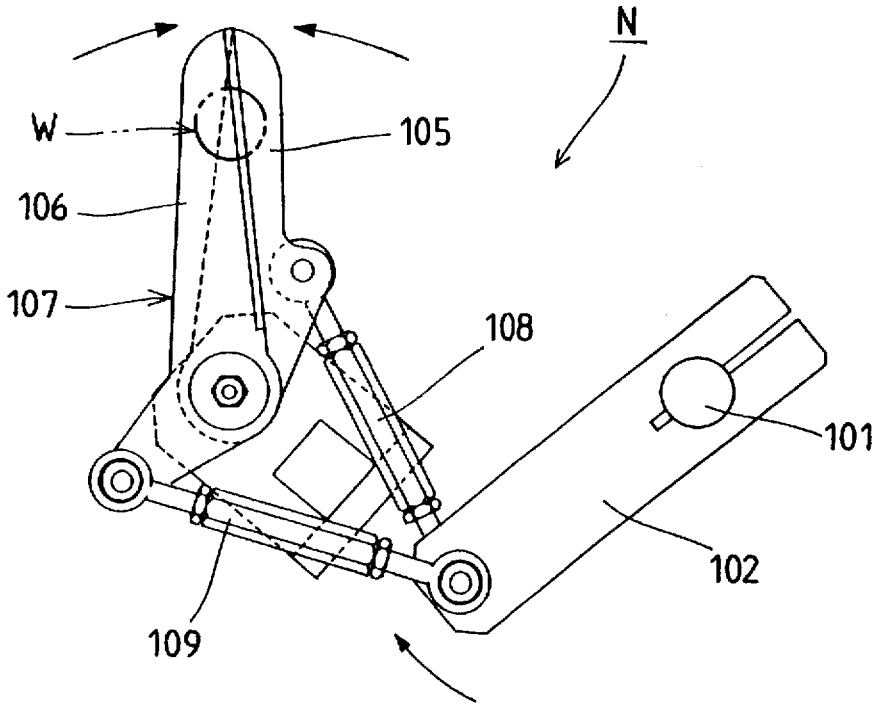
FIG. 29 is a front view of the sealed tab cutting unit according to the embodiment assuming a closed posture.
Figure 30:
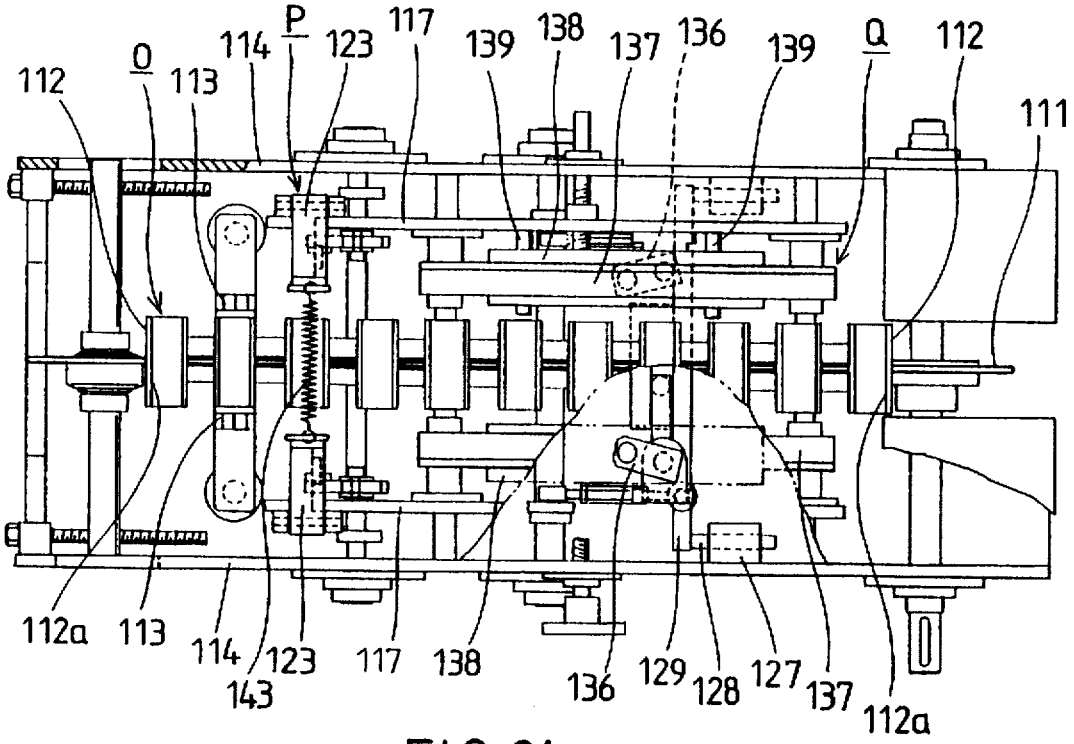
FIG. 30 is a partially cutaway schematic plane view of a carry-out conveyor in the assembly-packaging apparatus according to the embodiment.
Figure 31:
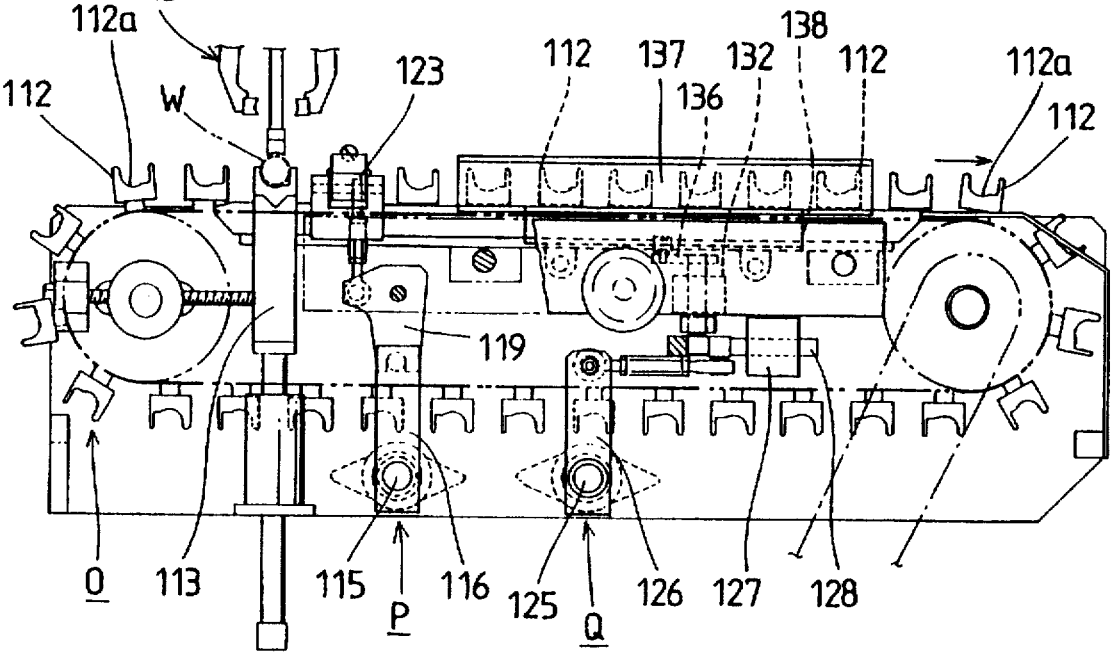
FIG. 31 is a partially cutaway schematic front view of the carry-out conveyor according to the embodiment.

A turnbuckle 108 is pivotally supported at one end on one knife 105 in each cutter 107 at a position spaced slightly away from the hinge of the cutter 107, whereas the other end of the turnbuckle 108 is pivotally supported at the free end portion of the lever 102. Meanwhile, another turnbuckle 109 is pivotally supported at one end on the other knife 106 in each cutter 107 at a position spaced away from the cutting edges beyond the hinge of the cutter 107, whereas the other end of the turnbuckle 109 is pivotally supported at the free end portion of the lever 102. Thus, the cutting edges of the knives 105,106 are moved closer to and farther from each other by turning the levers 102 in the positive and negative directions via the operating shaft 101, and each sealed tab fb coming between these knives 105 and 106 is designed to be cut when the knives 105,106 are moved closer to each other, as shown in FIGS. 28 and 29. Incidentally, the position of each cutter 107 is adjusted such that extra portions of the sealed tabs fb may be cut off so as to allow the sealed tabs fb to have dimensions not to protrude outer than the circular edges of the pellet-like article 24*a* when they are folded down along the end faces of the assembled pellet-like article group 24.

(Suction Duct for Sucking Film Chips)

A suction duct 110 as means for discharging film chips is disposed adjacent to each cutter 107 in the sealed tab cutting unit N, as shown in FIG. 27. Each suction duct 110 is connected to a suction source (not shown) and is adapted to suck film chips cut off by the cutter 107 and discharge them to the outside of the packaging machine.

(Carry-out Conveyor)

A carry-out conveyor O having a plurality of carriers 112 arranged on an endless chain 111 at predetermined intervals is disposed below the intermittent rotor 41. This conveyor O is driven to run intermittently by driving means (not shown) so that each carrier 112 may make a pause immediately below the article releasing position of the intermittent rotor 41. Incidentally, a groove 112*a* is defined on each carrier 112 so that a package W of pellet-like article group 24 wrapped with the packaging film F1 may be stably received by the carrier 112. The length of the carrier 112 is designed to be smaller than that of the package W.

Figure 32:
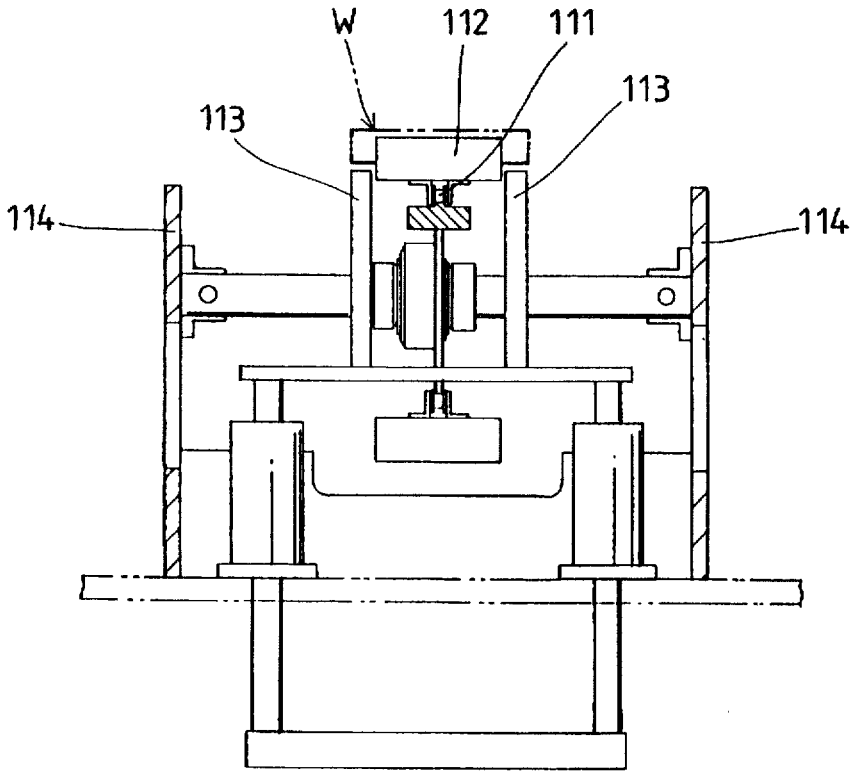
FIG. 32 is a side view of the major section of receiving members disposed in the carry-out conveyor according to the embodiment.

A pair of receiving members 113 are ascendably disposed at the article receiving position of the carry-out conveyor corresponding to the article releasing position of the intermittent rotor 41 to be spaced from each other in the direction orthogonal to the running direction of the carry-out conveyor O, as shown in FIG. 32. These receiving members 113 are designed to support the bottom of the package W at the end portions protruding outer than the carrier 112. The pair of receiving members 113 are ascended and descended by driving means (not shown) to move between an ascended position (FIG. 33) where they support the bottom of the package W held by the gripper 43 locating at the article releasing position and a descended position (FIG. 32) lower than the carrier 112. With the timing that the article holding unit G makes a pause at the article releasing position, the receiving members 113 locating at the descended position are ascended to the ascended position to support the package W at the bottom, and after the gripper 43 released the package W, the receiving members 113 are descended to the descended position to transfer the package W into the groove 112*a* of the carrier 112.

(Tab Folding Unit)

A tab folding unit (tab folding means) P is disposed in the carry-out conveyor 0 at another stopping position of the carrier 112 downstream the article receiving position. The tab folding unit P folds down the sealed tabs fb at each end of the package W received and retained by the carrier 112 along the end faces of the assembled pellet-like article group 24. This tab folding unit P consists of an operating shaft 115 rotatably supported between a pair of conveyor frames 114 of the carry-out conveyor O and a pair of first levers 116 fixed at the lower ends to the shaft 115 to be spaced from each other in the axial direction of the shaft 115. The first levers 116 are adapted to be oscillated in the running direction of the conveyor within a predetermined angular range by turning the operating shaft 15 in the positive and negative directions by driving means (not shown). Adjusting frames 117 are disposed inside the conveyor frames 114 respectively, and a pair of second levers 119 are pivotally supported via pins 118 onto the adjusting frames 117, with a notch 119a formed at the lower end of each second lever 119 being engaged with a clearance with a shaft 120 extended across the oscillating ends of the first levers 116. More specifically, the second levers 119 are oscillated on the pins 118 with the oscillation of the first levers 116 (see FIG. 35).

Figure 35:
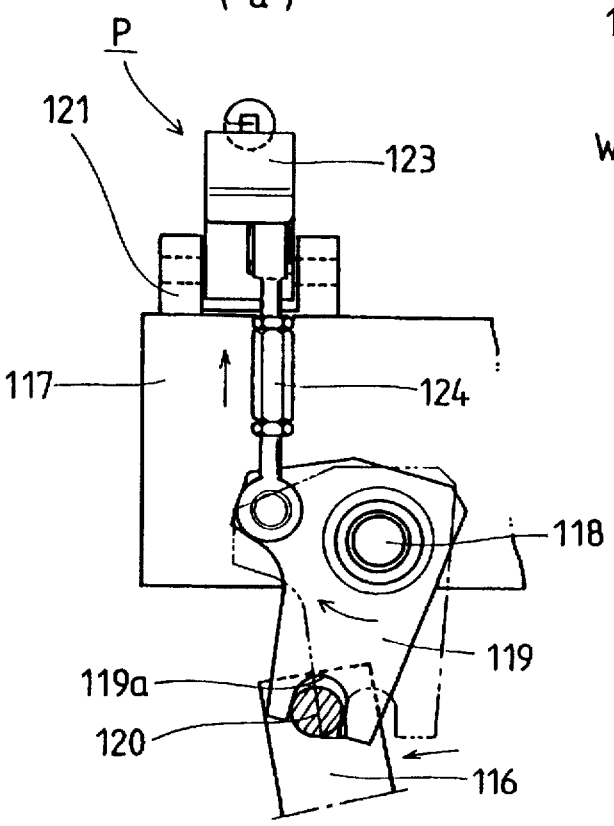
FIG. 35(*a*)–FIG. 35(*b*) are drawings for explaining actions of the tab folders according to the embodiment.
Figure 35:
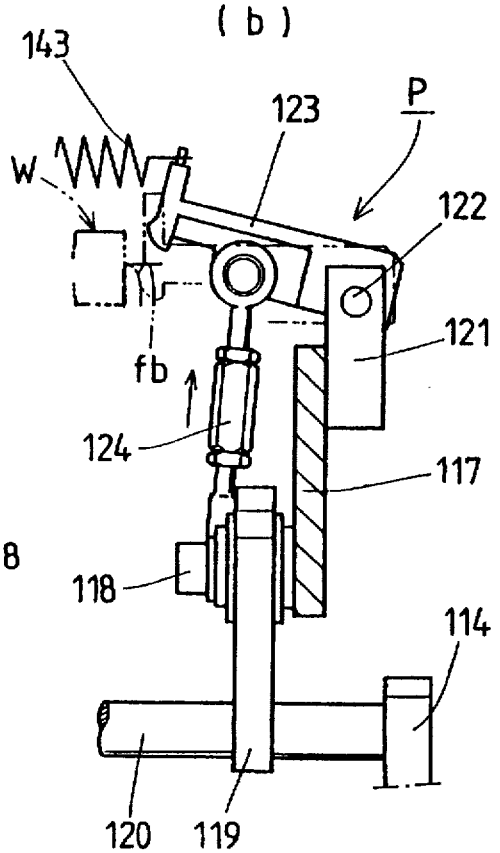

A pair of folders 123 are oscillatory supported via pins 122 on a pair of fitting members 121 attached to the adjusting frames 117 respectively, and the oscillating end portions of these folders 123 are designed to be able to abut downward against the sealed tabs fb of the package W carried on the carrier 112. A turnbuckle 124 is pivotally supported at one end to each second lever 119 at a position spaced upward from the pin 118 of the corresponding second lever 119, whereas the other end of the turnbuckle 124 is pivotally supported between the pin 122 of the folder 123 and the oscillating end portion thereof. More specifically, when the second levers 119 are oscillated via the first levers 116, the turnbuckles 124 are reciprocated vertically, and thus the folders 123 are oscillated vertically on the pins 122 respectively, as shown in FIG. 35. The sealed tabs fb are adapted to be folded down along the end faces of the assembled pellet-like article group 24 in the stroke that the oscillating end portions of the folders 123 are oscillated from the upper position to the lower position. An extension spring 143 is extended across the tops of the folders 123, and the package W is designed to be pressed by the spring 143 when the sealed tabs fb are to be folded down to prevent the package W from lifting from the carrier 112, facilitating neat folding of the sealed tabs fb.

(Fifth Sealing Unit)

Figure 36:
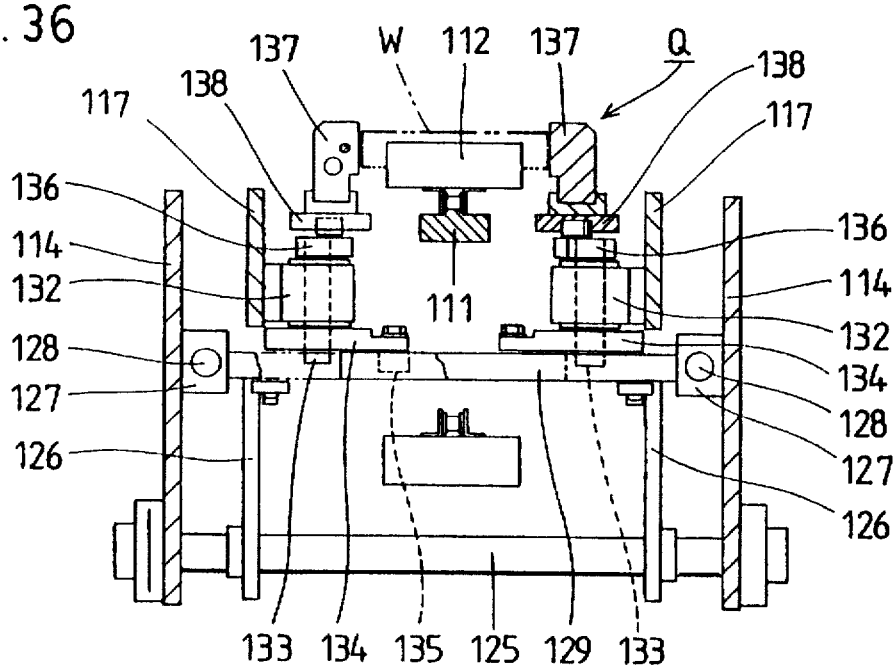
FIG. 36 is a side view of the major section of a fifth sealing unit disposed on the carry-out conveyor according to the embodiment.

A fifth sealing unit (fifth sealing means) Q, which seals the thus folded sealed tabs fb onto the portions of the packaging film present on the end faces opposing the sealed tabs fb, is provided on the conveyor O downstream the position where the sealed tabs fb are folded. The fifth sealing unit Q has a pair of levers 126 fixed at the lower end to an operating shaft 125 rotatably supported between the conveyor frames 114 to be spaced from each other in the axial direction of the shaft 125, as shown in FIG. 36. These levers 126 are designed to be oscillated within a predetermined angular range in the running direction of the conveyor when the operating shaft 125 is turned in the positive and negative directions by driving means (not shown). Further a pair of guides 127 are arranged to oppose each other inside the conveyor frames 114 and downstream the operating shaft 125, and a pair of slide shafts 128 are slidably fitted in these guides 127 respectively, with a roller guide 129 being extended across the upper ends of the slide shafts 128. A turnbuckle 130 pivotally supported at one end to the upper end of each lever 126 is pivotally supported at the other end to the roller guide 129, so that the roller guide 129 can be moved horizontally in the conveyor running direction with the oscillation of the levers 126.

Figure 37:
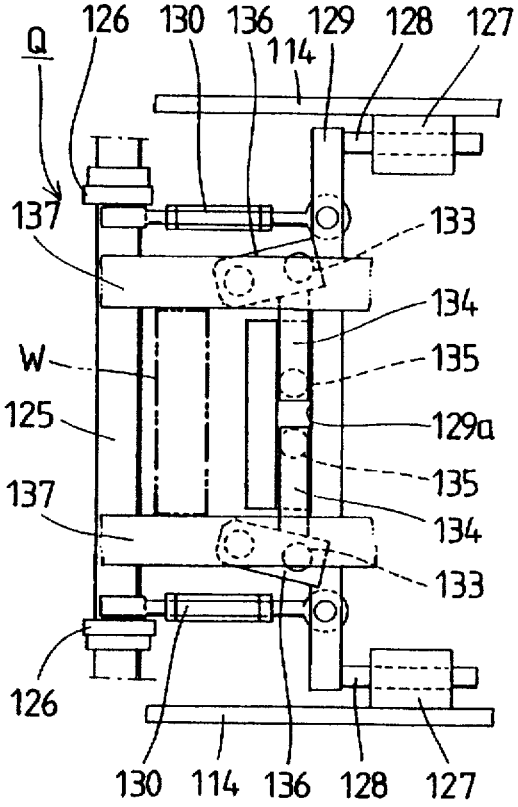
FIG. 37(*a*)–FIG. 37(*b*) are drawings is a drawing for explaining actions of the fifth sealing unit according to the embodiment.
Figure 37:
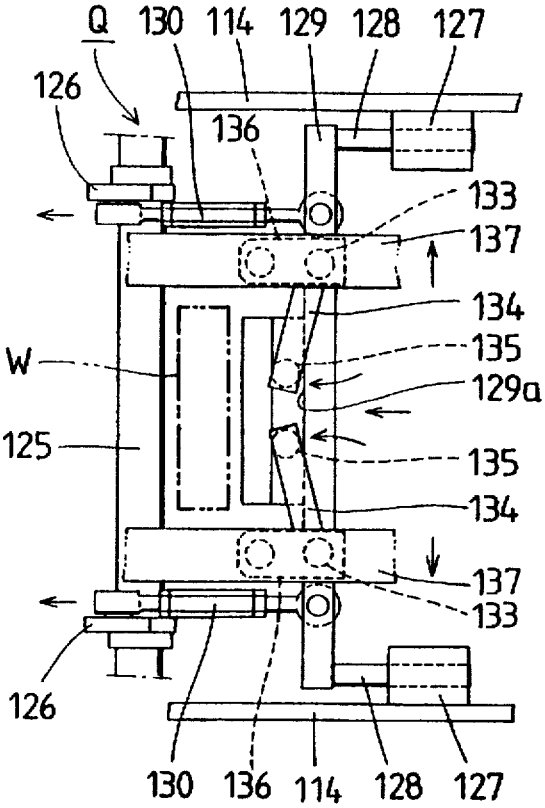

A pair of housings 132 are fixed to the opposing surfaces of the adjusting frames 117 positioned to oppose each other across the line along which articles are carried by the carriers 112, and a shaft 133 is vertically inserted rotatably to each housing 132. A lower lever 134 is fixed at one end to the lower end portion of each shaft 133 to be rotatable integrally with the shaft 133. A follower 135, which is fitted with clearance in a groove 129*a* defined in the roller guide 129 orthogonal to the package feeding direction, is rotatably supported at the free end portion of each lower lever 134. Further, an upper lever 136, the phase of which is different from that of the lower lever 134, is fixed at one end to the upper end portion of each shaft 133 to be able to turn integrally with the shaft 133. The free end portion of each upper lever 136 is pivotally supported on a plate 138 having a sealer 137. Incidentally, the plates 138 are slidably engaged with rails 139 provided on the adjusting frames 117 so that they may be moved horizontally closer to and farther from each other toward the article feeding line. More specifically, the upper and lower levers 134,136 attached to each shaft 133 are turned horizontally respectively when the roller guide 129 is moved horizontally via the levers 136, as shown in FIG. 37(*a*),(*b*) and thus the pair of sealers 137, disposed to oppose each other across the line along which articles are carried by the carriers 112, can be moved closer to and farther from each other. The package W carried on the carrier 112 is gripped at the end faces, when the pair of sealers 137 are moved closer to each other, and the sealed tabs fb are heat-sealed onto the opposing portions of the packaging film present on the end faces of the package W. Incidentally, the sealers 137 are extended in a predetermined length in the conveyor running direction so that the sealed tabs of packages W carried on the carriers 112 may be sealed several times by the sealers 137.

(Actions of the Embodiment)

Actions of the apparatus for assembly-packaging pellet-like article groups according to the embodiment will be described in relation with the assembly-packaging process. The belt-like film F is drawn by a predetermined length from the web roll 11 by intermittently driving the first feeding rollers 13 and the second feeding rollers 16 synchronously. The auxiliary slitting unit C located on the film drawing route is actuated with the timing that drawing of the belt-like film F is stopped, and an auxiliary slit r is formed by the anvil 26 and the small cutter 27 in the direction orthogonal to the film drawing direction.

Figure 4:
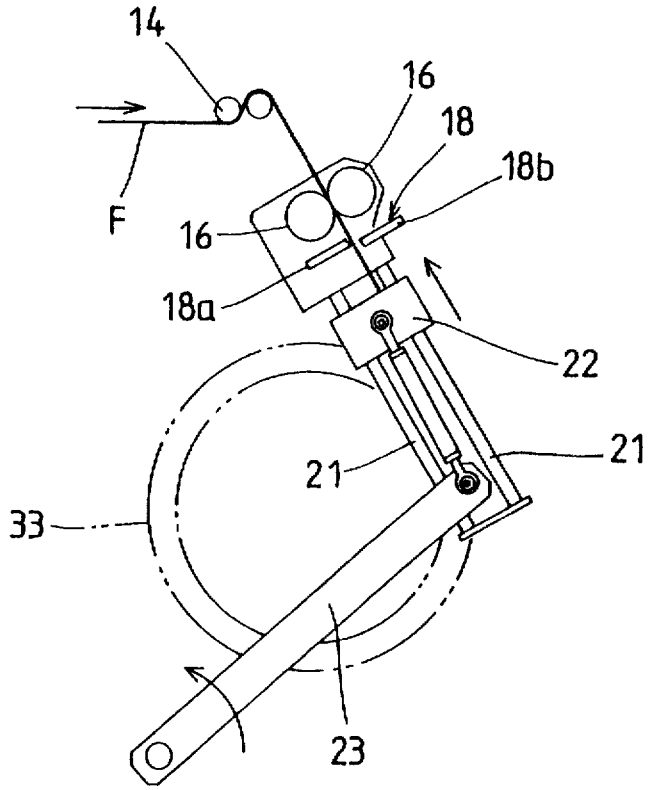
FIG. 4 is a drawing for explaining an action of the film feeding unit according to the embodiment.
Figure 5:
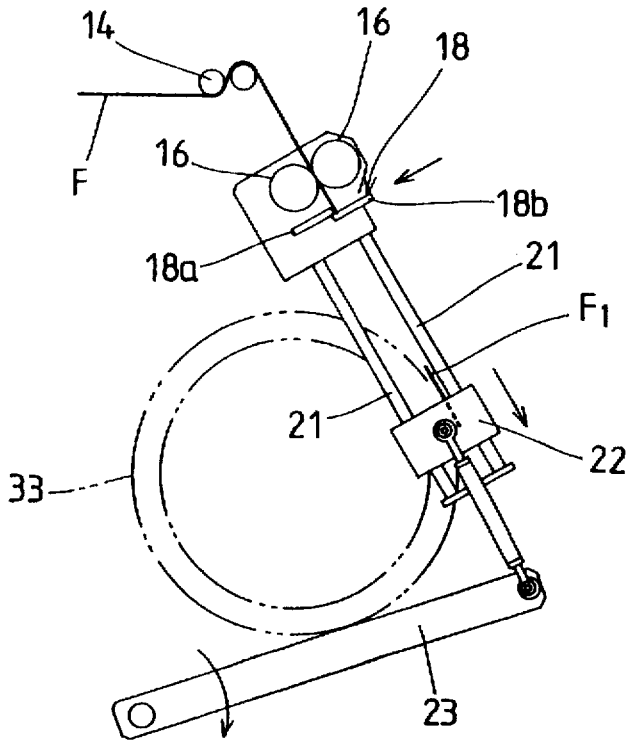
FIG. 5 is also a drawing for explaining an action of the film feeding unit according to the embodiment.
Figure 6:
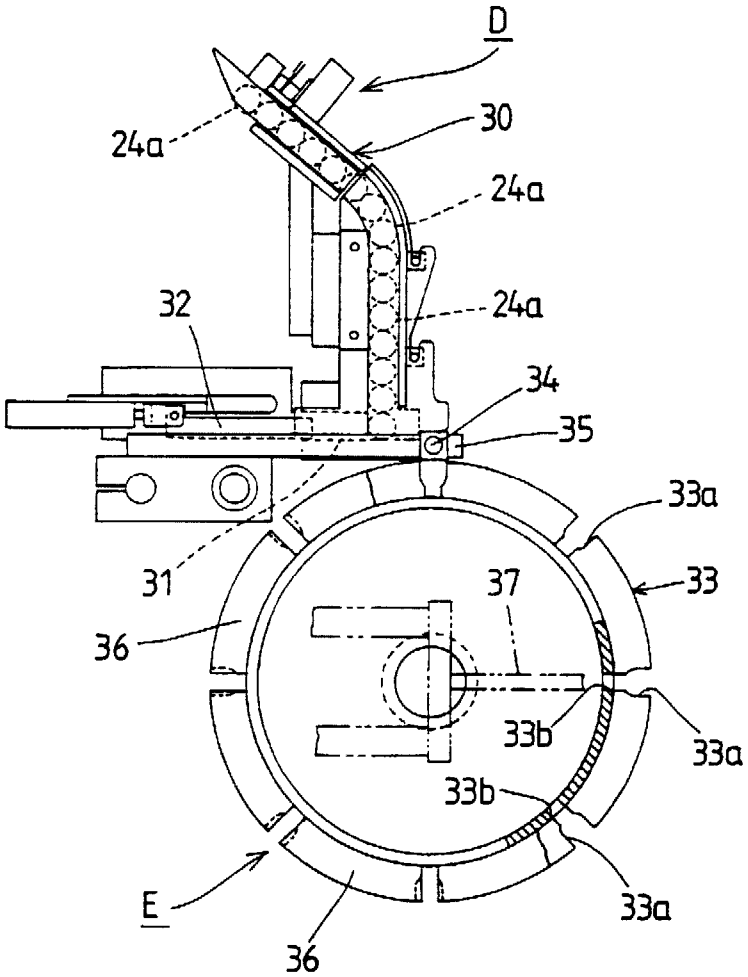
FIG. 6 is a front view of the major sections of an article introducing unit and of the article feeding unit in the assembly-packaging apparatus according to the embodiment.

The belt-like film F having the auxiliary slit r is fed to and between the first guide bars 17 and between the second guide plate 19 and the second guide bars 20 under intermittent driving of the first feeding rollers 13 and the second feeding rollers 16. In this instance, the movable blade 18*b* of the film cutter 18 disposed on the film outlet side of the second guide plate 19 and the second guide bars 20 is spaced away from the fixed blade 18*a* so as not to interfere with the passage of the belt-like film F, and the film F is fed by a predetermined length downstream from the location of the film cutter 18, as shown in FIG. 4. Meanwhile, the chucks 22 disposed on each side of the second guide plates 19 are locating at the gripping positions in the open postures (see FIG. 4). With the timing that the drawing of the belt-like film F is interrupted, the chucks 22 are actuated to chuck the belt-like film F at the longitudinal side edges, and also the movable blade 18*b* of the film cutter 18 is moved closer to the fixed blade 18*a* to cut the belt-like film F into a predetermined length. Subsequently, the pair of chucks 22 are moved from the gripping positions to the working positions to feed a packaging film F1 cut into a predetermined length chucked by the chucks 22 to the stand-by position.

Meanwhile, a plurality of pellet-like articles 24*a* supplied to the feeder chute 30 from the previous step are aligned in horizontal rows along the width of the packaging film F1 and fed as such through the chute 30, and the lowermost row of pellet-like articles 24*a* are supported on the supporting plate 31; as shown in FIG. 8(*a*). The pellet-like article group 24 resting on the supporting plate 31 is pushed forward to drop therefrom, as shown in FIG. 8(*b*), when the pusher 32 locating on the rear side of the feeder chute 30 is advanced. In this instance, since a circumferential part of the drum 33, disposed below the supporting plate 31, present between adjacent two pockets 33*a* is locating under the section between the supporting plate 31 and the restricting member 35, the pellet-like article group 24 dropped from the supporting plate 31 is transferred onto the circumference of the drum 33. After the pellet-like article group 24 is transferred onto the circumference of the drum 33, the pair of inching members 34 shown in FIG. 7 are moved closer to each other, and thus the pellet-like articles 24 are tightly brought together with the end faces thereof being abutted against one another. The drum 33 is then rotated until a pocket 33*a* is located under the section between the supporting plate 31 and the restricting member 35, as shown in FIG. 8(*c*), where the pellet-like article group 24 in which the pellet-like articles 24 are aligned with the end faced being abutted against one another is caught in that pocket 33*a*.

Figure 9:
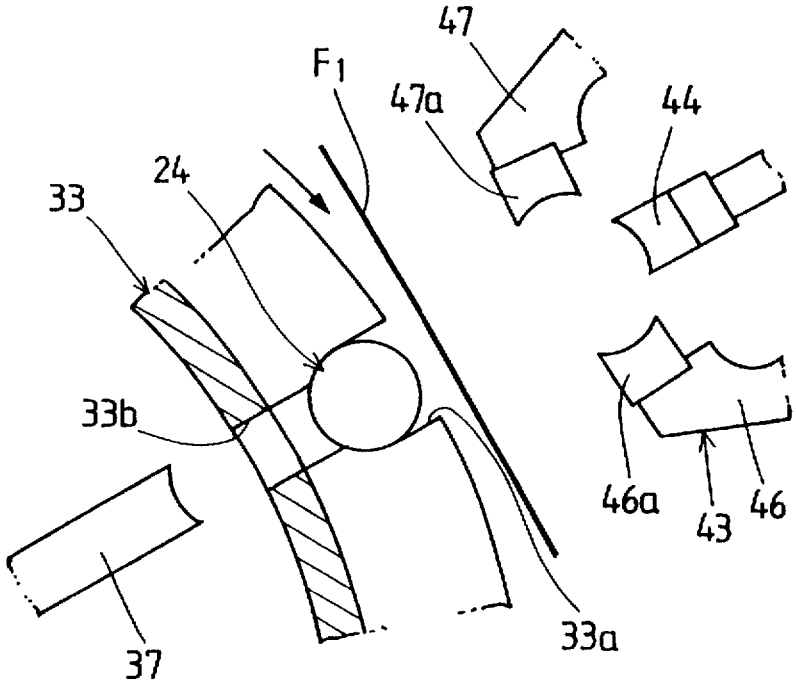
FIG. 9 is also a drawing for explaining an action of the article introducing unit according to the embodiment.
Figure 10:
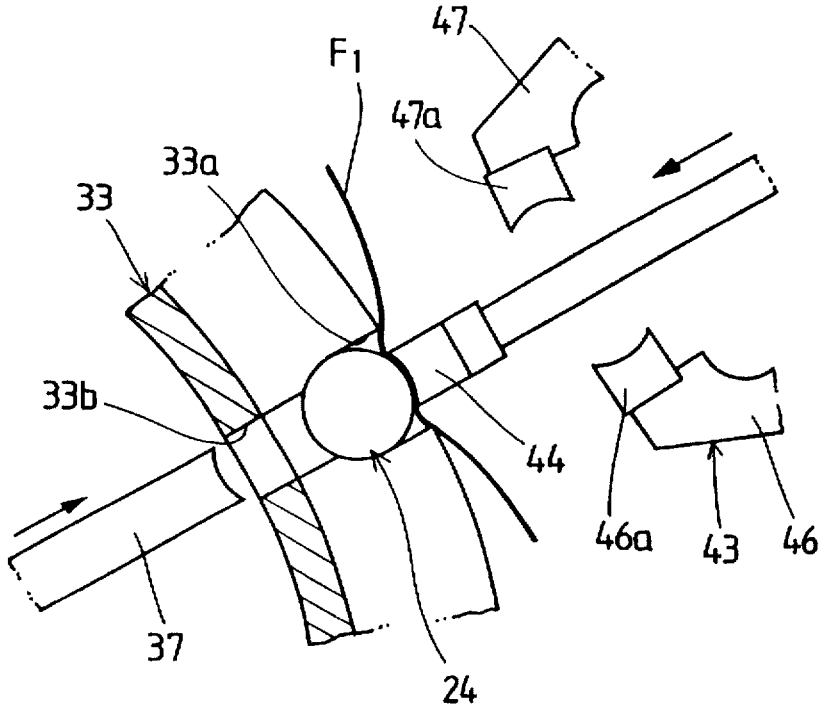
FIG. 10 is also a drawing for explaining an action of the article introducing unit according to the embodiment.
Figure 38:
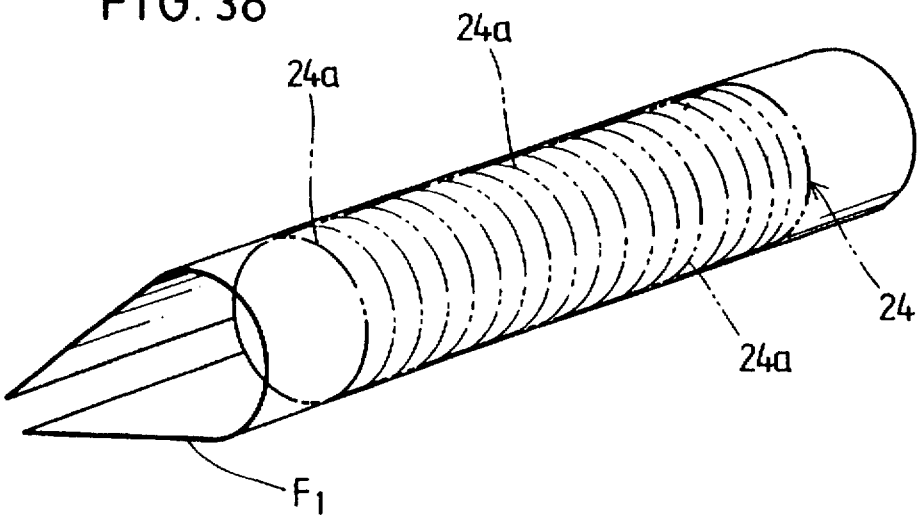
FIG. 38 is an explanatory drawing showing a step in the process that a pellet-like article group is wrapped with a packaging film by the assembly-packaging apparatus according to the embodiment.

When the drum 33 is further rotated intermittently to bring the pocket 33*a* carrying therein the pellet-like article group 24 to a position opposing the stand-by position to which the packaging film F1 is supplied and makes a pause there, as shown in FIG. 9, the ejecting member 37 locating at the retracted position is advanced to intrude into a slot 33*b* of the drum 33. Thus, the aligned pellet-like article group 24 caught in the pocket 33*a* is ejected as such by the ejecting member 37. In this instance, in the article holding unit G provided on the intermittent rotor 41 and making a pause at the article receiving position, the gripping jaws 46,47 of the gripper 43 are maintained in the open posture, and the supporting member 44 is protruding outward through the open space present between the gripping jaws 46 and 47 to locate at the extended position. Thus, the pellet-like article group 24 and the packaging film F1 to be ejected by the ejecting member 37 are held between the ejecting member 37 and the supporting member 44 locating at the extended positions, as shown in FIG. 10. When the ejecting member 37 is further advanced, the supporting member 44 is moved from the extended position to the retracted position against the resilience of the compression spring 56 to bring the pellet-like article group 24 and the packaging film F1 held between the ejecting member 31 and the supporting member 44 as such to the open space defined between the gripping jaws 46 and 47 (see FIG. 11). In the process that the packaging film F1 locating at the stand-by position is moved together with pellet-like article group 24 to the open space defined between the gripping jaws 46 and 47, the packaging film F1 is abutted against the gripping jaws 46,47 to be wrapped around pellet-like article group 24 (see FIG. 38). Next, when the gripper cam disc 49 is turned by a predetermined angle, the gripping jaws 46,47 locating at the article receiving position and assuming the open posture are moved closer to each other under the resilience of the spring 142 in the direction orthogonal to the direction in which pellet-like article group 24 is ejected by the ejecting member 37 and assume the gripping posture. Thus, pellet-like article group 24 are gripped by the gripping jaws 46,47 with the packaging film F1 being wrapped around it.

Subsequently, when the intermittent rotor 41 is further rotated intermittently downstream by a predetermined angle to make a pause there, the article holding unit G locating at the article receiving position is moved with the pellet-like article group 24 and the packaging film F1 being gripped thereby, and the next article holding unit G locating downstream the article receiving position is brought to the article receiving position to wait for receipt of another pellet-like article group 24. In this instance, the gripper cam disc 49 is also turned to allow the gripper 43 of the article holding unit G brought to the article receiving position to assume the open posture and also to move the supporting member 44 to the extended position.

Figure 18:
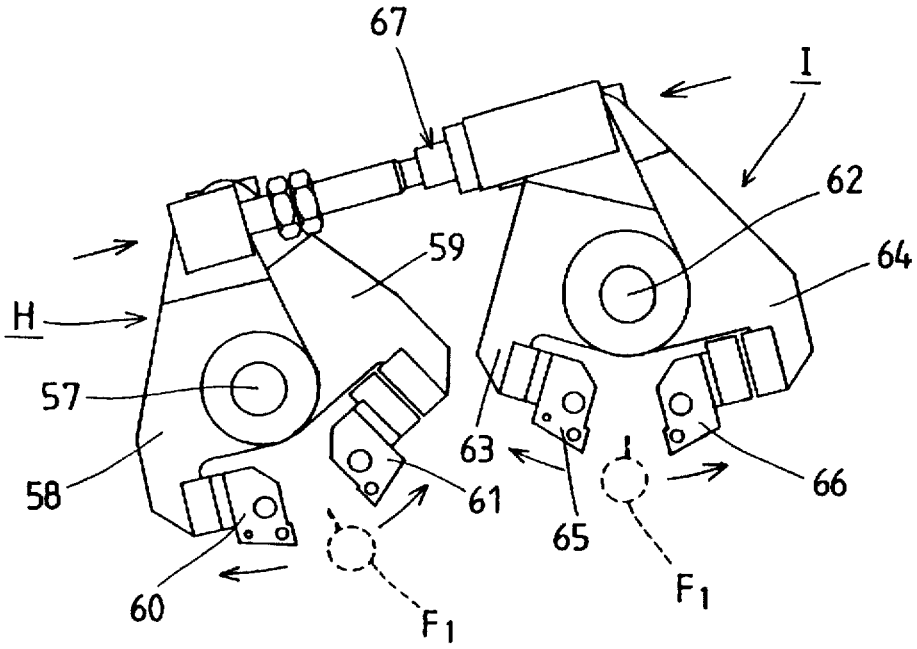
FIG. 18 is a front view of the first sealing unit and the second sealing unit in the assembly-packaging apparatus according to the embodiment which are assuming open postures.
Figure 19:
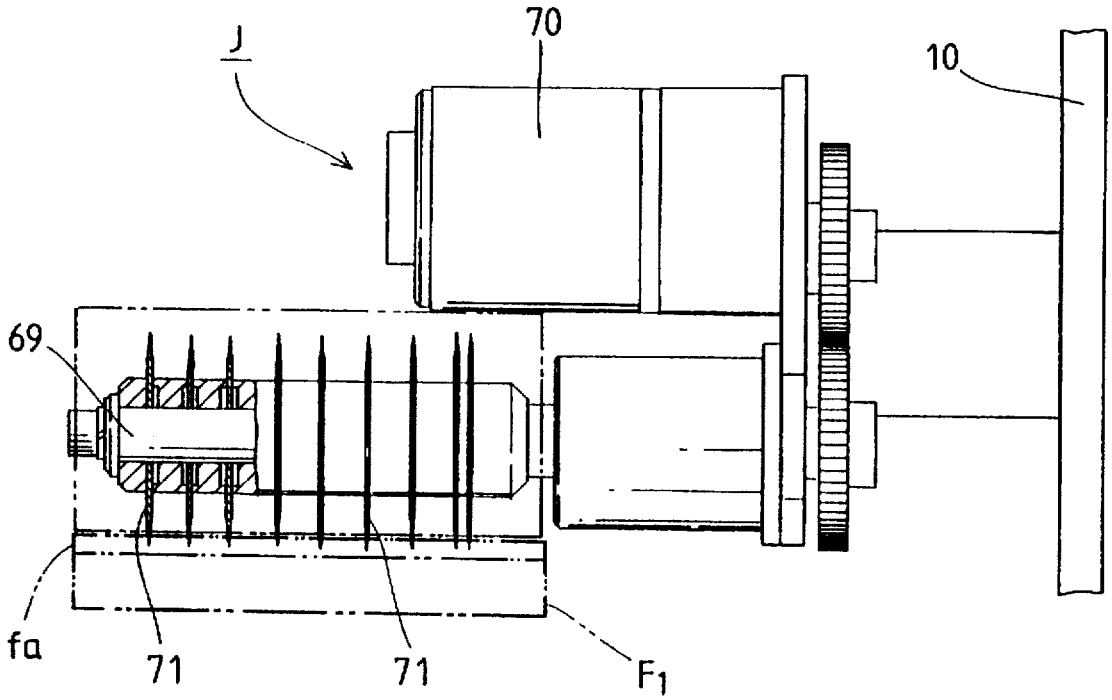
FIG. 19 is a partially cutaway side view of a slitting unit in the assembly-packaging apparatus according to the embodiment.
Figure 39:
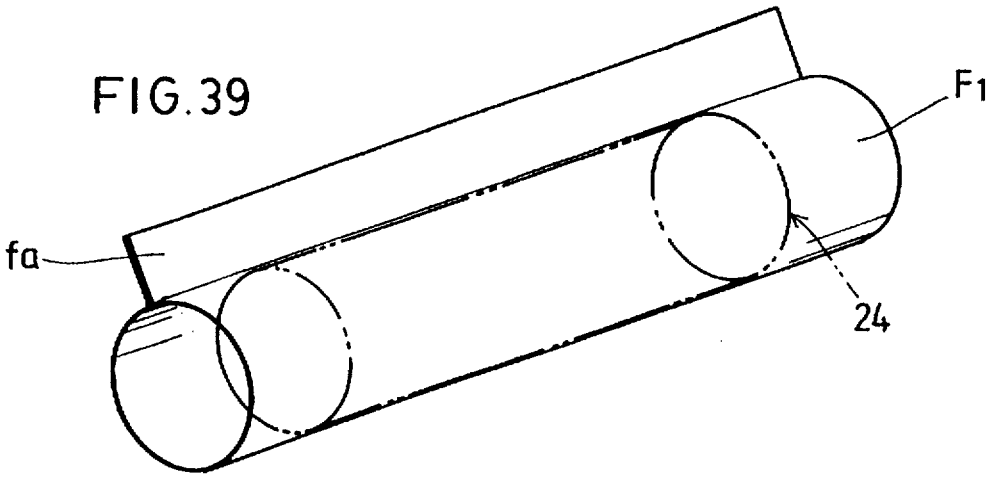
FIG. 39 is an explanatory drawing showing a step in the process that the pellet-like article group is wrapped with the packaging film by the assembly-packaging apparatus according to the embodiment.

By another rotation of the intermittent rotor 41, the article holding unit G gripping the pellet-like article group 24 and the packaging film F1 by the gripper 43 is brought to the preheat-sealing position where the first sealing unit H is disposed and makes a pause there. In this instance, the pair of sealers 60,61 in the first sealing unit H are assuming the open posture, as shown in FIG. 18, and the overlapping edges of the packaging film F1 are locating between these sealers 60 and 61. Accordingly, when the sealers 60,61 are closed as shown in FIG. 17, the overlapping edges of the packaging film F1 are preheat-sealed together to allow the film F1 to have a tubular form. Meanwhile, by another rotation of the intermittent rotor 41, the article holding unit G gripping the pellet-like article group 24, together with the packaging film F1 preheat-sealed along the overlapping edges, is brought to the sealing position where the second sealing unit I is disposed and makes a pause there. In this instance, the pair of sealers 65,66 in the second sealing unit I are assuming the open posture, as shown in FIG. 18, and the preheat-sealed portion of the packaging film F1 is locating between these sealers 65 and 66. Accordingly, when the sealers 65,66 are dosed, the preheat-sealed portion of the packaging film F1 is fully sealed to form a sealed rib fa (see FIG. 39).

Figure 40:
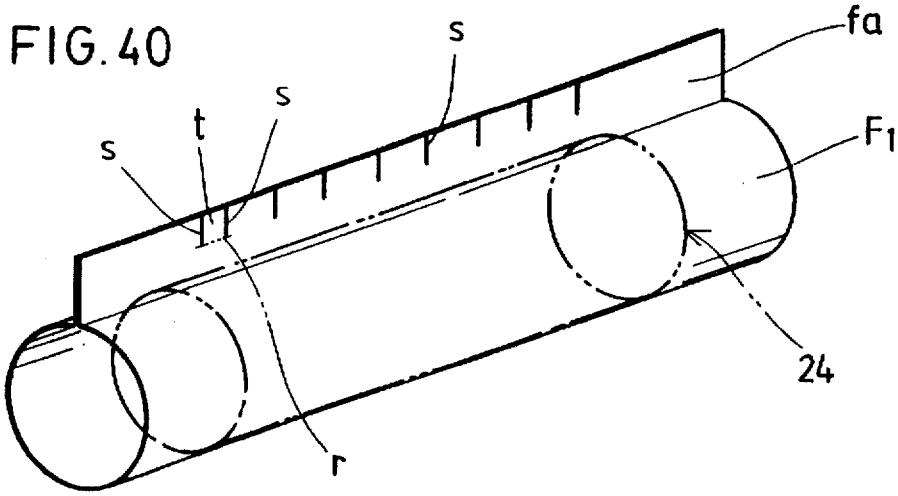
FIG. 40 is an explanatory drawing showing a step in the process that the pellet-like article group is wrapped with the packaging film by the assembly-packaging apparatus according to the embodiment.

By another rotation of the intermittent rotor 41, the article holding unit G holding the pellet-like article group 24 and the packaging film F1 having the sealed rib fa is brought to the slitting position where the slitting unit J shown in FIG. 20 is disposed and makes a pause there with the downstream side of the sealed rib fa being abutted against the support 68. When the drive motor 70 is actuated to rotate the drive shaft 69 with the timing that the intermittent rotor 41 is rotated and makes another pause to allow the cutting blades 71 attached to the shaft 69 to intrude into the corresponding vacant spaces 68*b* defined in the support 68, a plurality of tearing slits s are formed at the sealed rib fa at predetermined intervals in the longitudinal direction, as shown in FIG. 40. Incidentally, the distance between the first two slits located at one end portion of the tubular packaging film F1 is designed to be smaller than those between other slits, and the tongue t defined by these two slits s is used for opening the packaging film F1. One of the two film sheets constituting this tongue t has an auxiliary slit r formed by the auxiliary slitting unit C orthogonal to these slits s defining the tongue t to facilitate opening of the packaging film F1 by pulling off the tongue t.

Figure 41:
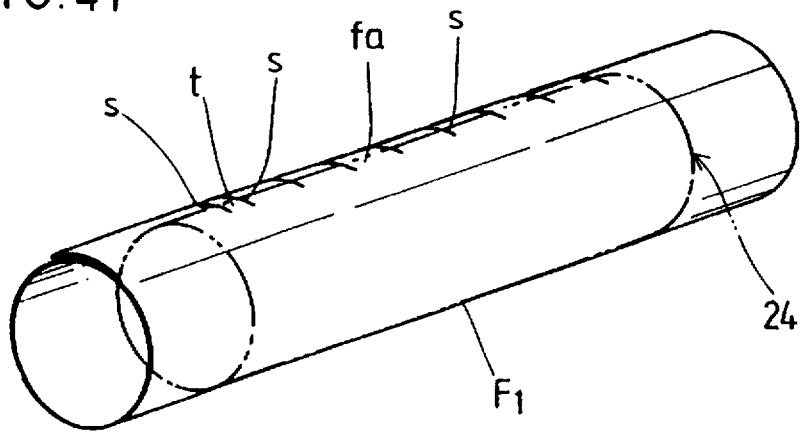
FIG. 41 is an explanatory drawing showing a step in the process that the pellet-like article group is wrapped with the packaging film by the assembly-packaging apparatus according to the embodiment.

The sealed rib fa having the tearing slits s is folded down along the barrel of the pellet-like article group 24, as shown in FIG. 41, by the lower surface 68*c* of the support 68 and by the arcuate portions 72*a* of the folding guide 72 located downstream the support 68 in the process that the article holding unit, G is moved downstream from the slitting position by another rotation of the intermittent rotor 41. The article holding unit G holding this pellet-like article group 24 is brought to the sealing position of the sealed rib fa to make a pause there, where the heat-sealing bar 77 of the third sealing unit K is moved toward the intermittent rotor 41 to be brought into abutment against the sealed rib fa of the packaging film F1, and thus the sealed rib fa is heat-sealed onto the opposing barrel portion of the packaging film F1 (see FIG. 41).

Figure 25:
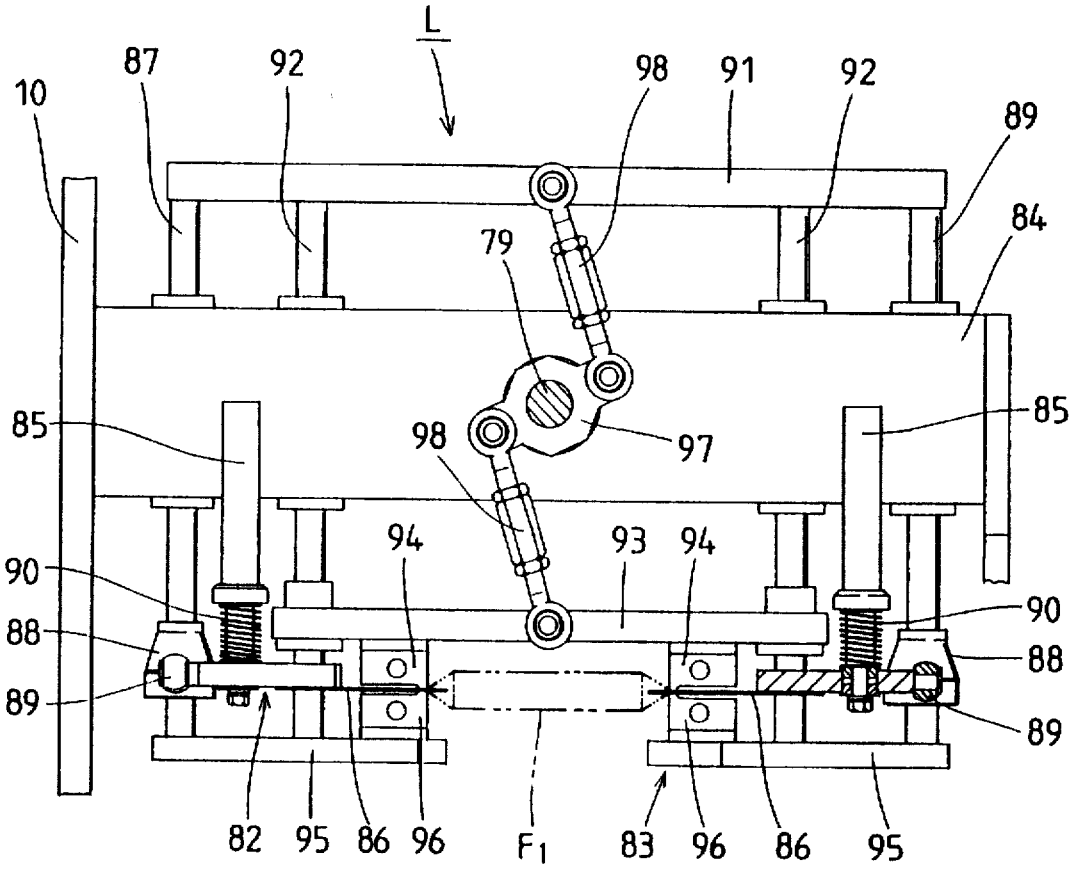
FIG. 25 is a side view of the gussetting and sealing unit according to the embodiment assuming a closed posture.
Figure 26:
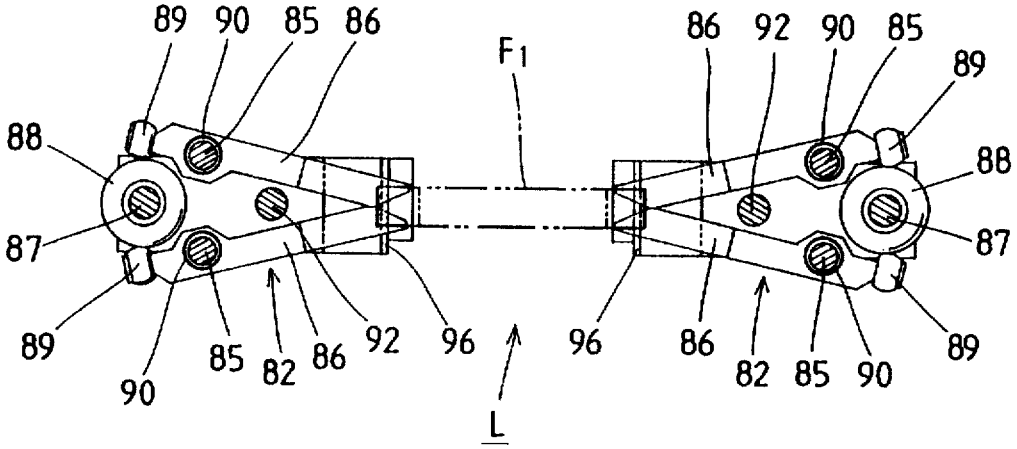
FIG. 26 is a horizontal cross-sectional plane view of the gussetting and sealing unit according to the embodiment assuming the closed posture.
Figure 42:
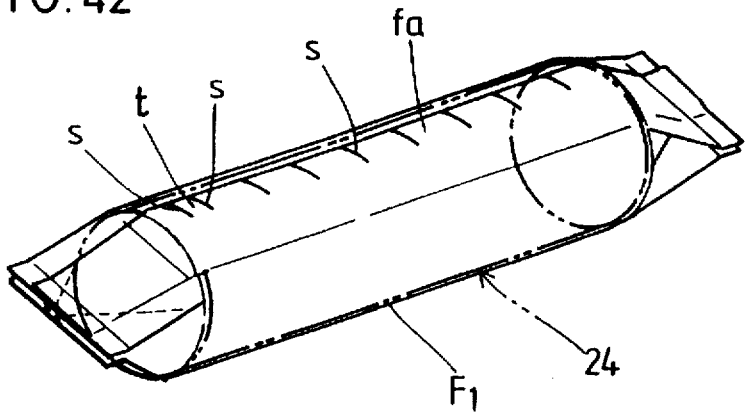
FIG. 42 is an explanatory drawing showing a step in the process that the pellet-like article group is wrapped with the packaging film by the assembly-packaging apparatus according to the embodiment.

By another rotation of the intermittent rotor 41, the article holding unit G holding the pellet-like article group 24 and the packaging film F1 is brought to the gussetting and sealing position where the gussetting and sealing unit L is disposed and makes a pause there. In this instance, the gussetting pawls 86 of the gussetter 82 and the upper sealers 94 and the lower sealers 96 in the partial sealer 83 are assuming open postures, as shown in FIGS. 23 and 24, and the each open end portion of the packaging film F1 gripped by the gripper 43 is locating between the gusseting pawls 86 and between the sealers 94 and 96. Accordingly, when the operating shaft 79 is turned in a predetermined direction to move the upper sealer holder 93 closer relative to the lower sealer holders 95, the rollers 89 of the gusseting pawls 86 abutted against the small-diameter portions of the cams 88 of the first slide shafts 87 are moved to be abutted against the large-diameter portions of the cams 88, respectively, to move the front end portions of the gusseting pawls 86 facing the pellet-like article group 24 closer to each other, and thus the open end portions of the packaging film F1 are folded inward or gussetted. Meanwhile, when the upper and lower sealers 94 and 96 are moved closer to each other to nip the open end portions of the packaging film F1 substantially at the center of the closing stroke of the pair of gussetting pawls 86, as shown in FIG. 25, the thus gussetted open end portions are partially sealed to maintain the gussetted state (see FIG. 42).

Figure 43:
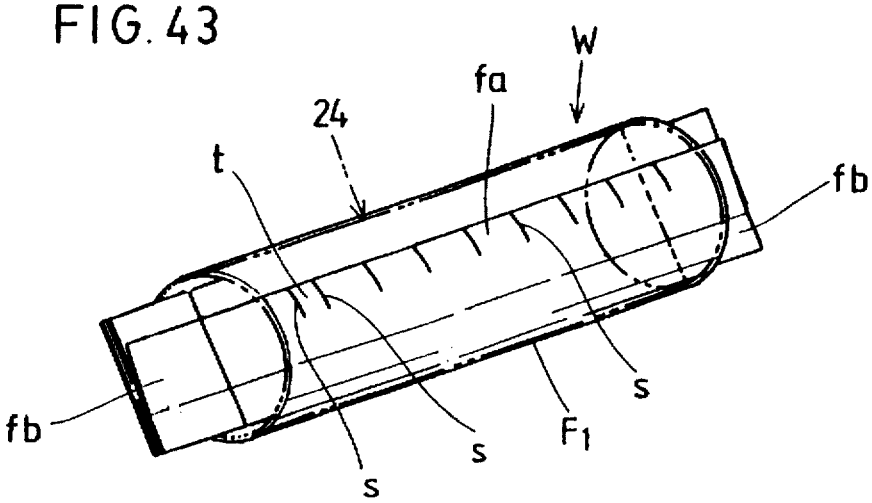
FIG. 43 is an explanatory drawing showing a step in the process that the pellet-like article group is wrapped with the packaging film by the assembly-packaging apparatus according to the embodiment.

By another rotation of the intermittent rotor 41, the article holding unit G holding the pellet-like article group 24 and the packaging film F1 is brought to the sealing position where the fourth sealing unit M shown in FIG. 21 is disposed and makes a pause there. In this instance, the upper sealer 99 and the lower sealer 100 in this sealing unit M are assuming the open posture, and the partially sealed open end portions of the packaging film F1 gripped by the gripper 43 are positioned between these sealers 99 and 100. Accordingly, the gussetted and partially sealed open end portions of the packaging film F1 are fully sealed to form sealed tabs fb respectively (see FIG. 43), when the operating shaft 79 of the fourth sealing unit M is turned in a predetermined direction to move the sealers 99 and 100 closer to each other. Incidentally, the gussetting and sealing unit L and the fourth sealing unit M are arranged to be offset by predetermined angles from the axis of the hollow shaft 40, so that the sealed tabs fb of the packaging film F1 can be formed to be orthogonal to the perpendicular line passing the longitudinal center line of the sealed rib fa (see FIG. 44), thus improving appearance of the package W.

Figure 45:
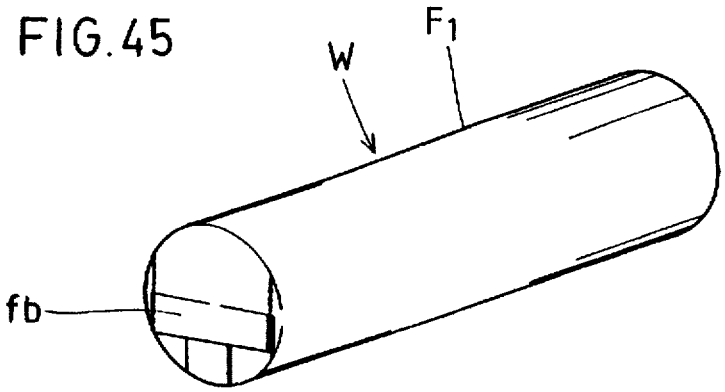
FIG. 45 is an explanatory drawing showing a step in the process that the pellet-like article group is wrapped with the packaging film by the assembly-packaging apparatus according to the embodiment.

By another rotation of the intermittent rotor 41, the article holding unit G holding the pellet-like article group 24 and the packaging film F1 is brought to the tab cutting position where the sealed tab cutting unit N is disposed and makes a pause there. In this instance, the cutting edges of each pair of knives 105,106 in the sealed tab cutting unit N are assuming the open posture, as shown in FIG. 28, and each sealed tab fb of the packaging film F1 is located between these knives 105 and 106. Accordingly, when the lever 102 is turned via the operating shaft 101 in a predetermined direction, the cutting edges of the knives 105,106 are moved closer to each other, as shown in FIG. 29, to cut the sealed tab fb locating between the knives 105 and 106 (see FIG. 44). Incidentally, the sealed tab cutting unit N is designed to cut extra portions of the sealed tabs fb such that the sealed tabs fb may not protrude outer than the circular edges of the pellet-like article 24*a* when they are folded down along the end faces of the assembled pellet-like article group 24, as shown in FIG. 45. Meanwhile, the film chips are discharged outside the packaging machine through the suction ducts 110.

Figure 33:
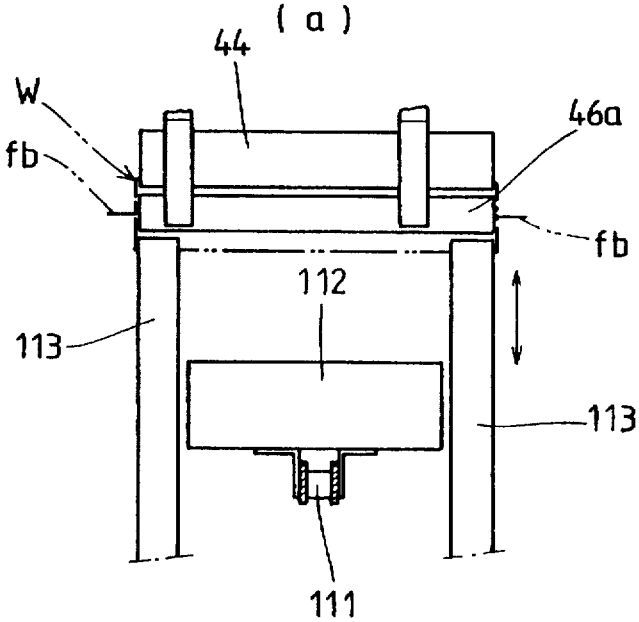
FIG. 33(*a*)–FIG. 33(*b*) are drawings for explaining actions of the receiving members according to the embodiment.
Figure 33:
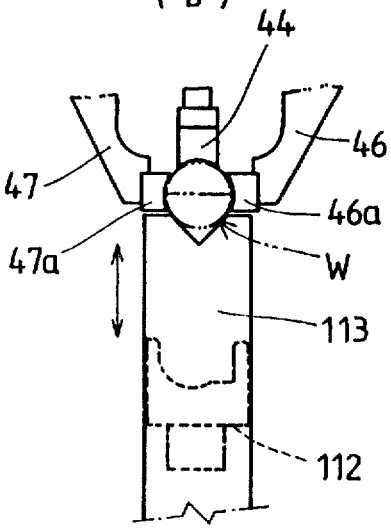
Figure 34:
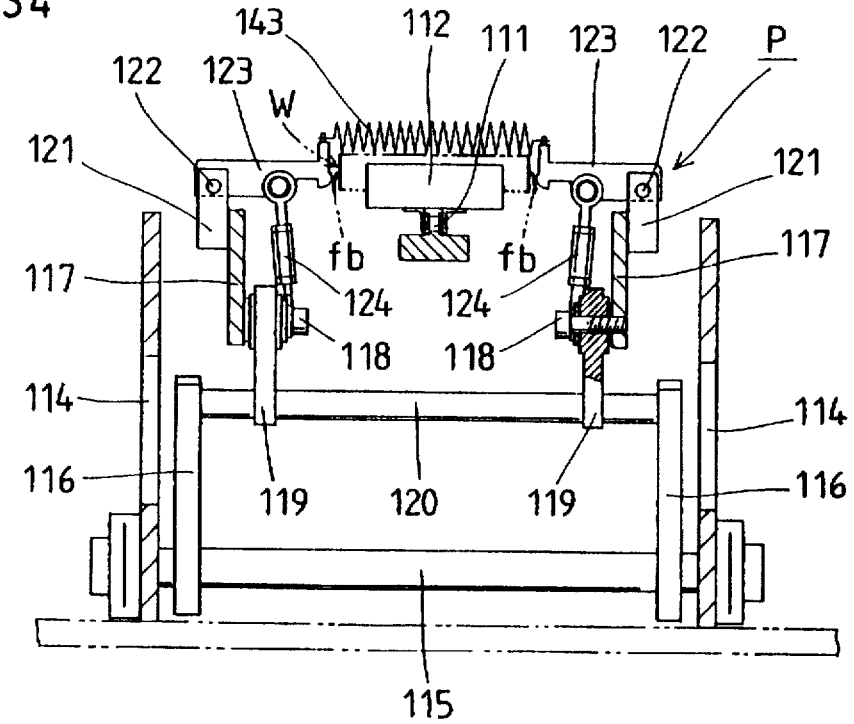
FIG. 34 is a side view of the major section of tab folders disposed in the carry-out conveyor according the embodiment.

By another rotation of the intermittent rotor 41, the article holding unit G holding a package W of the pellet-like article group 24 wrapped with the packaging film F1 is brought to the article releasing position immediately above the carry-out conveyor O and makes a pause there. In this instance, the releasing cam face of the gripper cam disc 49 is not locating at the article releasing position, and the gripper 43 of the article holding unit G is still holding the package W under the resilience of the spring 142. Meanwhile, with the timing that the intermittent rotor 41 is rotated intermittently to make another pause, the receiving members 113 located at the article receiving position of the carry-out conveyor O are ascended to the ascended positions, as shown in FIG. 33(*a*),(*b*), to hold the package W between the receiving members 113 and the supporting member 44.

Next, the gripper cam disc 49 is turned in a predetermined direction until the releasing cam face is brought to the article releasing position, where the grabbing pieces 46*a*, 47*a* of the gripper 43 are spaced from each other to release the package W. In this process, the package W is held between the supporting member 44 and the receiving members 113 so that it may not drop. The receiving members 113 are descended to the descended positions in this state, and the package W supported between these members 113 and the supporting member 44 is transferred into the groove 1 12a of the carrier 112 locating at the article receiving position.

The carry-out conveyor O is driven intermittently to move the carrier 112 carrying thereon the package W downstream from the article receiving position to the sealed tab folding position and makes a pause there. In this instance, the folders 123 in the tab holding unit P disposed at the tab folding position are locating at the ascended positions, as shown in FIG. 35(*a*),(*b*), where they do not interfere with the sealed tabs fb of the package W carried on the carrier 112. Accordingly, the sealed tabs fb locating on these oscillating strokes of the folders 123 are folded downward along the end faces of the assembled pellet-like article group 24 by oscillating these folders 123 from the upper positions to the lower positions. Further, when the folders 123 are oscillated to the lower positions, the extension spring 143 attached across the tops of these members 123 presses down the package W to prevent the package W from lifting and facilitate folding of the sealed tabs fb.

The carry-out conveyor O is driven intermittently to move the carrier 112 carrying thereon the package W downstream from the folding position and to stop it at the zone where a fifth sealing unit Q is disposed. In this instance, the pair of sealers 137 in this fifth sealing unit Q are spaced away from each other, as shown in FIG. 37(*a*), so as to permit passage of the package W carried on the carrier 112. Accordingly, the pair of sealers 137 can be abutted against the end faces of the package W carried on the carrier 112 by moving these sealers 137 closer to each other, as shown in FIG. 37(*b*) to hold the package W therebetween. Thus, the sealed tabs fb folded down by the tab folding unit P are sealed against the opposing portions of the packaging film F1 present on the end faces, respectively. Incidentally, since the sealers 137 are extended over a predetermined length in the conveyor running direction, the sealed tabs fb of the package W carried on the carrier 112 are sealed several times each time the carry-out conveyor O makes a pause, thus providing a sealed package in which the sealed tabs fb are securely heat-sealed onto the portions of the film present on the end faces of the pellet-like article group 24.

In the assembly-packaging apparatus according to the embodiment described above, the sealed tabs are folded down and sealed to the end faces after the package is transferred from the gripper to the carry-out conveyor. However, this invention is not to be limited to such constitution. For example, the folding and sealing of the sealed tabs may be carried out in the state where the package is held by the article holding unit disposed on the intermittent rotor. Further, the units starting from the slitting unit downstream to the sealed tab cutting unit described in the foregoing embodiment are arranged successively at the stopping positions of the grippers provided on the intermittent rotor. However, this invention is not to be limited to such constitution. For example, the stopping positions of the grippers provided on the intermittent rotor may be secured between these units.

Although only one embodiment of the present invention has been described herein, it should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope of the appended claims.

What is claimed is:

1. A process for assembly-packaging pellet-like articles in units of a predetermined number, which comprises:

supplying a packaging film obtained by cutting a double-side heat-sealable belt-like film drawn from a web roll into a predetermined length to a stand-by position;

ejecting a pellet-like article group, consisting of an assembly of pellet-like articles fed to a position where it opposes said packaging film with the end faces of said pellet-like articles being abutted against one another in alignment, toward said packaging film at the stand-by position;

gripping the thus ejected pellet-like article group and said packaging film half-wrapped around it with gripping means which is rotated intermittently by predetermined angles;

putting together overlapping edges of said packaging film half-wrapped around said pellet-like article group and preheat-sealing said overlapping edges together to allow said packaging film to have a tubular form, at a stopping position of said gripping means;

sealing said preheat-sealed overlapping edges of said packaging film fully to form a sealed rib, at the next stopping position of said gripping means;

folding down said sealed rib along the barrel of said pellet-like article group, and heat-sealing the thus folded sealed rib onto the portion of said packaging film opposing said sealed rib, at the next stopping position of said gripping means;

gussetting both open end portions of said tubular packaging film and preheat-sealing together overlapping two-sheet portion of each open end portion remaining ungussetted, at the next stopping position of said gripping means;

sealing said gussetted and preheat-sealed end portions fully to form sealed tabs, at the next stopping position of said gripping means;

cutting said sealed tab to a predetermined length at the next stopping position of said gripping means; and folding down each sealed tab along the end face of said assembled pellet-like article group and heat-sealing the thus folded sealed tab onto the portion of said packaging film opposing said tab.

2. The process for assembly-packaging pellet-like articles according to claim 1, wherein tearing slits are formed at said sealed rib before it is folded down along the barrel of said pellet-like article group.

3. The process for assembly-packaging pellet-like articles according to claim 2, wherein at least two tearing slits are formed adjacent to each other at said sealed rib, and an auxiliary slit is formed, between said slits, in one sheet of the sealed rib opposing the barrel of said pellet-like article group in the process that said belt-like film is drawn from said web roll.

4. An apparatus for assembly-packaging pellet-like articles in units of a predetermined number, which comprises:

film feeding means for cutting a double-side heat-sealable belt-like film drawn from a web roll into a sheet with a predetermined length, feeding the thus obtained packaging film to a stand-by position, and holding said film sheet in position;

article introducing means for introducing pellet-like articles by a predetermined number in alignment;

article feeding means having an ejecting member for ejecting a pellet-like article group consisting of an assembly of said pellet-like articles introduced by said article introducing means with the end faces of said pellet-like articles being abutted against one another in alignment toward said packaging film;

an intermittent rotor, disposed to oppose said article feeding means across the stand-by position, which is rotated and stopped by predetermined angles;

a plurality of article holding means, disposed on said intermittent rotor at predetermined angular intervals, each containing a supporting member which moves interlocking with said ejecting member in the direction that said member is moved and holds said pellet-like article group and said packaging film in cooperation with said ejecting member and a gripper which grips said pellet-like article group ejected by said ejecting member together with said packaging film half-wrapped around said pellet-like article group against the ejecting direction;

first sealing means, which is disposed downstream the position where pellet-like article group is transferred from said article feeding means to said article holding means with respect to the rotational direction of said intermittent rotor and contains a pair of sealers, disposed to be movable closer to and farther from each other, for nipping together overlapping edges of said packaging film half-wrapped around said pellet-like article group gripped by said gripper and preheat-sealing the thus nipped overlapping edges, when said intermittent rotor is at pause;

second sealing means, which is disposed downstream said first sealing means with respect to the rotational direction of said intermittent rotor and contains a pair of sealers, disposed to be movable closer to and farther from each other, for nipping said overlapping edges of said packaging film preheat-sealed by said first sealing means and sealing the thus nipped edges to form a sealed rib, when said intermittent rotor is at pause;

folding guide means, which is disposed downstream said second sealing means with respect to the rotational direction of said intermittent rotor, for folding down said sealed rib of said packaging film formed by said second sealing means along the barrel of said pellet-like article group with the rotation of said intermittent rotor;

third sealing means, which is disposed downstream said folding guide means with respect to the rotational direction of said intermittent rotor, for heat-sealing the thus folded sealed rib onto the portion of said packaging film wrapped along the profile of said pellet-like article group, when said intermittent rotor is at pause;

gussetting and sealing means disposed downstream said third sealing means with respect to the rotational direction of said intermittent rotor and contains, on each side of said assembled pellet-like article group, a pair of gussetting pawls which can be moved closer to and farther from each other horizontally with said open end portion of said tubular packaging film being located therebetween and a pair of sealers which can be moved closer to and farther from each other vertically toward said open end portions, so that each open end portion may be folded inward by said gussetting pawls to form a gusset and that each open end portion thus gussetted may be sealed partly by said pair of sealers substantially at the center of the closing stroke of said gussetting pawls, when said intermittent rotor is at pause;

fourth sealing means disposed downstream said gussetting and sealing means with respect to the rotational direction of said intermittent rotor and contains, on each side of said assembled pellet-like article group a pair of sealers which can be moved closer to and farther from each other with said open end portion of said packaging film gussetted and partially sealed by said gussetting and sealing means being located therebetween and which nips and seals said gussetted and partially sealed end portion to form a sealed tab, when said intermittent rotor is at pause;

sealed tab cutting means which is disposed downstream said fourth sealing means with respect to the rotational direction of said intermittent rotor and contains, on each side of said assembled pellet-like article group, a pair of cutting members for cutting said sealed tabs formed by said fourth sealing means into a predetermined length, when said intermittent rotor is at pause;

discharge means disposed adjacent to each cutting member of said sealed tab cutting means, for discharging film chips cut off by said cutting member outside the packaging apparatus;

tab folding means for folding down the thus cut sealed tabs along the end faces of said assembled pellet-like article group; and fifth sealing means for heat-sealing each sealed tab folded by said tab folding means onto the portion of said packaging film opposing said tab.

5. The apparatus for assembly-packaging pellet-like articles according to claim 4, further comprising a slitting means which supports on a support said sealed rib of said packaging film on the downstream side with respect to the rotational direction of said intermittent rotor and forms a tearing slit at said sealed rib by advancing a cutting edge from the other side toward vacant spaces defined in said support.

6. The apparatus for assembly-packaging pellet-like articles according to claim 5, wherein said slitting means contains at least two cutting edges arranged adjacent to each other, and said apparatus further comprises, on the route of drawing said belt-like film from said web roll, auxiliary slitting means for forming beforehand in said belt-like film an auxiliary slit orthogonal to two tearing slits to be formed at the sealed rib by said cutting edges disposed, said auxiliary slit is designed to be formed by said auxiliary slitting means such that said slit may be present only on one sheet of said packaging film at the thus folded sealed rib.

7. The apparatus for assembly-packaging pellet-like articles according to any of claims 4, 5 and 6, wherein an intermittently driven carry-out conveyor having thereon a plurality of carriers which can receive and carry thereon packages the sealed tabs of which having been trimmed by said sealed tab cutting means are arranged at predetermined intervals is disposed below said intermittent rotor so that a package coming to an article receiving position may be transferred to a carrier, when said article holding means holding said package is opposed to said article receiving position, from said article holding means by releasing holding of said package;

said tab folding means and said fifth sealing means are disposed on said carry-out conveyor;

said tab folding means is provided with a pair of ascendable folders disposed to be spaced away from each other by a predetermined distance in the direction orthogonal to the running direction of said carry-out conveyor so that said sealed tabs of said package W may be folded along the end faces of said assembled pellet-like article group by descending said folders toward the roots of said sealed tabs of the package carried on said carrier; and said fifth sealing means is provided with a pair of sealers disposed on each side of the article carrying line of said carriers to oppose each other to be movable closer and father relative to each other so that said folded sealed tabs of said package carried on said carrier may be heat-sealed onto the portions of said packaging film present on the end faces opposing said sealed tabs by moving said sealers closer to each other toward said article carrying line.

* * * * *